US008741521B2

(12) United States Patent
Hozumi et al.

(10) Patent No.: US 8,741,521 B2
(45) Date of Patent: Jun. 3, 2014

(54) TONER, DEVELOPER, IMAGE FORMING METHOD AND IMAGE FORMING APPARATUS

(75) Inventors: Mamoru Hozumi, Miyagi (JP); Tsuyoshi Sugimoto, Shizuoka (JP); Naohiro Watanabe, Shizuoka (JP); Tomoyuki Satoh, Kanagawa (JP); Shinya Hanatani, Shizuoka (JP); Osamu Uchinokura, Shizuoka (JP); Kiwako Hirohara, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 13/232,518

(22) Filed: Sep. 14, 2011

(65) Prior Publication Data

US 2012/0064447 A1 Mar. 15, 2012

(30) Foreign Application Priority Data

Sep. 15, 2010 (JP) ..... 2010-206472

(51) Int. Cl.
*G03G 9/087* (2006.01)

(52) U.S. Cl.
USPC ..... 430/109.4; 430/108.4; 430/123.5; 430/111.4

(58) Field of Classification Search
USPC ..... 430/108.4, 109.4, 111.4, 123.5
See application file for complete search history.

(56) References Cited

U.S. PATENT DOCUMENTS

| | | | | |
|---|---|---|---|---|
| 7,306,887 | B2 | 12/2007 | Tanaka et al. | |
| 7,413,839 | B2 | 8/2008 | Matsumoto et al. | |
| 7,449,273 | B2 | 11/2008 | Ohki et al. | |
| 7,459,255 | B2 | 12/2008 | Tanaka et al. | |
| 7,550,243 | B2 | 6/2009 | Matsumoto et al. | |
| 7,550,245 | B2 | 6/2009 | Inoue et al. | |
| 7,662,532 | B2 | 2/2010 | Tomita | |
| 7,718,339 | B2 | 5/2010 | Tomita et al. | |
| 7,829,254 | B2 | 11/2010 | Kurose et al. | |
| 8,007,977 | B2 | 8/2011 | Inoue et al. | |
| 2003/0129518 | A1* | 7/2003 | Sawada et al. | 430/109.4 |
| 2007/0218381 | A1 | 9/2007 | Uchinokura et al. | |
| 2007/0218390 | A1 | 9/2007 | Nozaki et al. | |
| 2008/0057430 | A1* | 3/2008 | Takahashi et al. | 430/109.4 |
| 2008/0096119 | A1 | 4/2008 | Yamamoto et al. | |
| 2008/0102393 | A1 | 5/2008 | Hasegawa | |
| 2009/0075195 | A1 | 3/2009 | Shu et al. | |
| 2010/0129748 | A1 | 5/2010 | Inoue et al. | |
| 2010/0216068 | A1 | 8/2010 | Kotsugai et al. | |
| 2010/0310980 | A1 | 12/2010 | Sugimoto et al. | |
| 2011/0002719 | A1 | 1/2011 | Shu et al. | |
| 2011/0076612 | A1 | 3/2011 | Awamura et al. | |
| 2011/0223532 | A1* | 9/2011 | Sugimoto et al. | 430/109.4 |
| 2011/0262856 | A1* | 10/2011 | Sugimoto et al. | 430/109.4 |
| 2012/0052431 | A1* | 3/2012 | Hozumi et al. | 430/111.4 |

FOREIGN PATENT DOCUMENTS

| | | |
|---|---|---|
| CN | 101055436 A | 10/2007 |
| JP | 2005-15589 | 1/2005 |

OTHER PUBLICATIONS

U.S. Appl. No. 13/208,941, filed Aug. 12, 2011, Hozumi, et al.
U.S. Appl. No. 13/210,773, filed Aug. 16, 2011, Sugimoto, et al.
U.S. Appl. No. 13/086,833, filed Apr. 14, 2011, Sugimoto, et al.
Chinese Office Action issued Aug. 30, 2012, in Patent Application No. 201110272799.6 (with partial English-language translation).

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner containing toner particles, each toner particle containing: a releasing agent; a colorant; and a binder resin containing at least a crystalline polyester resin and a non-crystalline polyester resin, wherein in the case where a volume average particle diameter of the toner is defined as Dv, the toner contains a group of the toner particles having 4/5 Dv, and a group of the toner particles having 6/5 Dv, and wherein an endothermic value A of the crystalline polyester resin at a first temperature increase in DSC of the toner, an endothermic value B of the crystalline polyester resin at a first temperature increase in DSC of the group of the toner particle having 4/5 Dv, and an endothermic value C of the crystalline polyester resin at a first temperature increase in DSC of the group of the toner particles having 6/5 Dv satisfy the relation represented by the following formulas:

$$50<(B/A)\times 100<90, \text{ and}$$

$$110<(C/A)\times 100<150.$$

9 Claims, 4 Drawing Sheets

TONER, DEVELOPER, IMAGE FORMING METHOD AND IMAGE FORMING APPARATUS

BACKGROUND OF THE INVENTION

1. Field of the Invention

The present invention relates to a toner used for an image forming apparatus, such as a copier, facsimile, printer, etc., and a developer containing the toner, a developer container, a process cartridge, an image forming apparatus and an image forming method, which use the toner, developer, developer container, and process cartridge.

2. Description of the Background

Conventionally, electric latent images or magnetic latent images are made visible with a toner in image forming apparatuses by electrophotography, electrostatic recording method, or the like. In the electrophotography, for example, after forming a latent electrostatic image on a photoconductor, the latent electrostatic image is developed with a toner to form a toner image. The toner image is generally transferred to a recording medium such as paper, and then melted by heating so as to be fixed thereon.

In recent years, demand has arisen for toners having various advantageous properties such as small particle diameters for forming high-quality output images and improved low-temperature fixing ability for energy saving.

Toners obtained by the conventional kneading-pulverizing method are not easily made to have a small particle diameter. In addition, their shape is amorphous and their particle size distribution is broad. Furthermore, these toners have various problems such as requiring a large amount of energy for being fixed, and thus energy saving is hard to achieve.

In particular, in the kneading-pulverizing method, cracks occur at the interfaces of a releasing agent (wax) during pulverization, resulting in that the releasing agent exists on the toner surface in a large amount. As a result, although the releasing effects for fixation can be obtained, toner adhesion to a carrier, a photoconductor and a blade is likely to occur. The properties of such toners are not satisfactory in terms of the image forming process.

In order to overcome the above-described problems the kneading-pulverizing method has, there is proposed a method for producing a toner by the polymerization method. According to the polymerization method, toners are made easily to have a small particle diameter. Their particle size distribution is sharper than that of the toners obtained by the pulverizing method. Furthermore, the wax can be incorporated in the toner particles.

In such polymerization method, improvement of low temperature fixing ability is desired for energy saving. Moreover, according to the improvement of the low temperature fixing ability, it is desired not to impair the heat resistant storage stability and hot offset resistance of toner. To these problems, it is attempt to use, as a binder resin of the toner, polyester resins having excellent low temperature fixing ability and relatively favorable heat resistant storage stability, instead of conventionally used styrene-acrylic resins.

Moreover, Japanese Patent Application Laid-Open (JP-A) No. 2005-15589 discloses use of a crystalline polyester dispersion liquid for introduction of a crystalline polyester in a toner. Since the crystalline polyester resin contained in the toner has crystallinity, the resultant toner has thermofusion properties that the viscosity of the toner dramatically decreases at around the fixing onset temperature (fusion onset temperature). Specifically, the toner has the desirable heat resistant storage stability just below the fusion onset temperature because of the crystallinity, and shows dramatic viscosity reduction (sharp melt) at the fusion onset temperature so as to be fixed. Thus, the toner having both excellent heat resistant storage stability and low temperature fixing ability can be designed. Moreover, such the toner has also excellent releasing width (i.e. difference between the minimum fixing temperature and hot offset occurring temperature).

JP-A No. 2005-15589 discloses that, as a method of producing a crystalline polyester dispersion liquid, a crystalline polyester alone is mixed in a solvent, and then heated and cooled to produce a coarse dispersion liquid, followed by pulverizing the crystalline polyester contained in the produced coarse dispersion liquid with a mechanical pulverization device, to thereby obtain a crystalline polyester dispersion liquid having a volume average particle diameter of 0.2 μm to 1 μm, which is suitably used for toner.

However, it is difficult for the crystalline polyester resin to be dispersed to have a sharp particle size distribution by the method for producing a crystalline polyester dispersion liquid disclosed in JP-A No. 2005-15589. Consequently, the particle size distribution of the toner becomes poor.

On the other hand, the inventors of the present invention have intensively studied a toner in which the crystalline polyester resin is contained, and found that a toner having a small particle diameter tends to have excellent low temperature fixing ability, but poor heat resistant storage stability, and a toner having a large particle diameter tends to have excellent heat resistant storage stability, but poor low temperature fixing ability, in the particle size distribution of the toner. Thus, even though the toner containing the crystalline polyester resin has a particle size distribution to some extend, it is considered that the amount of the crystalline polyester resin to be contained needs to be optimized depending on the particle size distribution, so that the toner has stable and suitable heat resistant storage stability and low temperature fixing ability as a whole.

BRIEF SUMMARY OF THE INVENTION

The present invention aims to provide a toner having stable and suitable low temperature fixing ability and heat resistant storage stability, a developer containing the toner, a developer container, a process cartridge, an image forming apparatus and an image forming method, which use the toner, developer, developer container, and process cartridge.

Means for solving the problems is as follows.

<1> A toner containing:toner particles, each toner particle containing: a binder resin; a releasing agent; and a colorant, wherein the binder resin contains at least a crystalline polyester resin and a non-crystalline polyester resin, wherein in the case where a volume average particle diameter of the toner is defined as Dv, the toner contains a group of the toner particles having the volume average particle diameter of 4/5Dv, and a group of the toner particles having the volume average particle diameter of 6/5Dv, and wherein an endothermic value A of the crystalline polyester resin at a first temperature increase in a differential scanning calorimetry of the toner, an endothermic value B of the crystalline polyester resin at a first temperature increase in a differential scanning calorimetry of the group of the toner particles having the volume average particle diameter of 4/5Dv after classification, and an endothermic value C of the crystalline polyester resin at a first temperature increase in a differential scanning calorimetry of the group of the toner particles having the volume average particle diameter of 6/5Dv after classification satisfy the relation represented by the following formulas:

$$50<(B/A)\times100<90, \text{ and}$$

$$110<(C/A)\times100<150.$$

<2> The toner according to <1>, wherein the endothermic value A, the endothermic value B, and the endothermic value C satisfy the relation represented by the following formulas:

$$60<(B/A)\times100<80, \text{ and}$$

$$110<(C/A)\times100<130.$$

<3> The toner according to any one of <1> and <2>, wherein an exothermic value D of the releasing agent upon temperature decrease after the first temperature increase in the differential scanning calorimetry of the toner, an exothermic value E of the releasing agent upon temperature decrease after the first temperature increase in the differential scanning calorimetry of the group of the toner particles having the volume average particle diameter of 4/5Dv after classification, and an exothermic value F of the releasing agent upon temperature decrease after the first temperature increase in the differential scanning calorimetry of the group of the toner particles having the volume average particle diameter of 6/5Dv after classification satisfy the relation represented by the following formulas:

$$50<(E/D)\times100<90, \text{ and}$$

$$110<(F/D)\times100<150.$$

<4> The toner according to any one of <1> to <3>, wherein the toner is obtained by emulsifying or dispersing in an aqueous medium a liquid in which a toner material containing the binder resin and the releasing agent is dissolved or dispersed in an organic solvent.

<5> The toner according to any one of <1> to <4>, wherein the toner is obtained by a method including: dissolving or dispersing at least the colorant, the releasing agent, the crystalline polyester resin, a compound containing an active hydrogen group, a binder resin precursor having a portion reactive with the compound containing an active hydrogen group, and a binder resin component other than the foregoing in an organic solvent to obtain an oil phase; dispersing the oil phase in the aqueous medium to obtain an emulsified dispersion liquid, allowing the binder resin precursor and the compound containing an active hydrogen group to undergo a crosslinking reaction, an elongation reaction, or both thereof in the emulsified dispersion liquid, and removing the organic solvent.

<6> The toner according to any one of <1> to <3>, wherein the toner is obtained by a method including: dispersing the crystalline polyester resin and the non-crystalline polyester resin respectively in a separate aqueous media to emulsify the crystalline polyester resin and the non-crystalline polyester resin as crystalline polyester resin particles, and non-crystalline polyester resin particles, respectively; mixing the crystalline polyester resin particles, the non-crystalline polyester resin particles, a releasing agent dispersion liquid, and a colorant dispersion liquid to prepare a dispersion liquid containing aggregated particles; fusing the aggregated particles into toner particles; and washing the toner particles.

<7> The toner according to any one of <1> to <6>, wherein the crystalline polyester resin has an average dispersed particle diameter of 0.1 μm to 2.0 μm in the toner particles.

<8> A developer containing the toner according to any one of <1> to <7>.

<9> A developer container, including: a container; and the developer according to <8> housed in the container.

<10> A process cartridge, including: a latent electrostatic image bearing member; and a developing unit containing the toner according to any one of <1> to <7> therein, and configured to develop a latent electrostatic image formed on the latent electrostatic image bearing member with the toner, so as to form a visible image, wherein the process cartridge is detachably mounted in a main body of an image forming apparatus.

<11> An image forming method including: forming a latent electrostatic image on a latent electrostatic image bearing member; developing the latent electrostatic image with the toner according to any one of <1> to <7> to form a visible image; transferring the visible image to a recording medium; and fixing the visible image transferred to the recording medium thereon.

<12> An image forming apparatus, including: a latent electrostatic image bearing member; a latent electrostatic image forming unit configured to form a latent electrostatic image on the latent electrostatic image bearing member; a developing unit containing the toner according to any one of <1> to <7> therein, and configured to develop the latent electrostatic image with the toner so as to form a visible image; a transfer unit configured to transfer the visible image to a recording medium; and a fixing unit configured to fix the visible image transferred to the recording medium thereon.

In the present invention, the amount of the crystalline polyester resin contained in the toner is optimized according to the particle size distribution, since the amount of the crystalline polyester resin contained in the toner can be determined by an endothermic value of the crystalline polyester resin at the first temperature increase in a differential scanning calorimetry of the toner. Namely, by satisfying the above described relation of the endothermic values of the whole toner particles having a particle size distribution, the group of the toner particles each having a small diameter (hereinafter referred to as a small toner particles), and the group of the toner particles each having a large diameter (hereinafter referred to as a large toner particles), which are obtained in the respective differential scanning calorimetries, the small toner particles contain a small amount of the crystalline polyester rein, and the large toner particles contain a large amount of the crystalline polyester resin. Since the small toner particles contain a small amount of the crystalline polyester resin, the degradation of the heat resistant storage stability of the small toner particles is suppressed. As the large toner particles contain a large amount of the crystalline polyester resin, the effect of low temperature fixing ability of the large toner particles is enhanced. Thus, even though the toner containing the crystalline polyester resin has a particle size distribution to some extent, the toner can have stable and suitable heat resistant storage stability and low temperature fixing ability as a whole. This will be specifically described as follows.

In the case where (B/A)×100 is 90 or more, the amount of the crystalline polyester resin increases in the small toner particles having a volume average particle diameter of 4/5Dv, which are obtained by classifying the whole toner particles with a particle size distribution, and the crystalline polyester resin is easily exposed on the surface of the toner particle, causing degradation of the heat resistant storage stability. Thus, by decreasing the amount of the crystalline polyester resin contained in the small toner particles, i.e., (B/A)×100 is less than 90, suitable heat resistant storage stability is obtained. However, in the case where (WA)×100 is 50 or less, the amount of the crystalline polyester resin in the binder resin component excessively decreases, and the crystalline polyester resin becomes less compatible with the non-crystalline polyester resin, causing degradation of the low temperature fixing ability. Thus, it is necessary that (B/A)×100 is more than 50.

On the other hand, in the case where (C/A)×100 is 110 or less in the large toner particles having a volume average particle diameter of 6/5Dv, which are obtained by classifying the whole toner particles with a particle size distribution, the low temperature fixing ability is degraded. Thus, by increasing the amount of the crystalline polyester resin contained in the toner particles, i.e., (C/A)×100 is more than 110, the low temperature fixing ability is secured. However, in the case where (C/A)×100 is 150 or more, the amount of the crystalline polyester resin contained in the toner particle excessively increases, and the crystalline polyester resin is easily exposed on the surface of the toner particle, causing degradation of the heat resistant storage stability. Thus, it is necessary that (C/A)×100 is less than 150.

Therefore, by satisfying the relation represented by the formulas 50<(B/A)×100<90 and 110<(C/A)×100<150, the toner can have stable and suitable low temperature fixing ability and heat resistant storage stability as a whole.

The present invention exhibits excellent effects to provide a toner having stable and suitable low temperature fixing ability and heat resistant storage stability, a developer containing the toner, a developer container, a process cartridge, an image forming apparatus and an image forming method, which use the toner, developer, developer container, and process cartridge.

DETAILED DESCRIPTION OF THE INVENTION (Toner)

Figure 1:
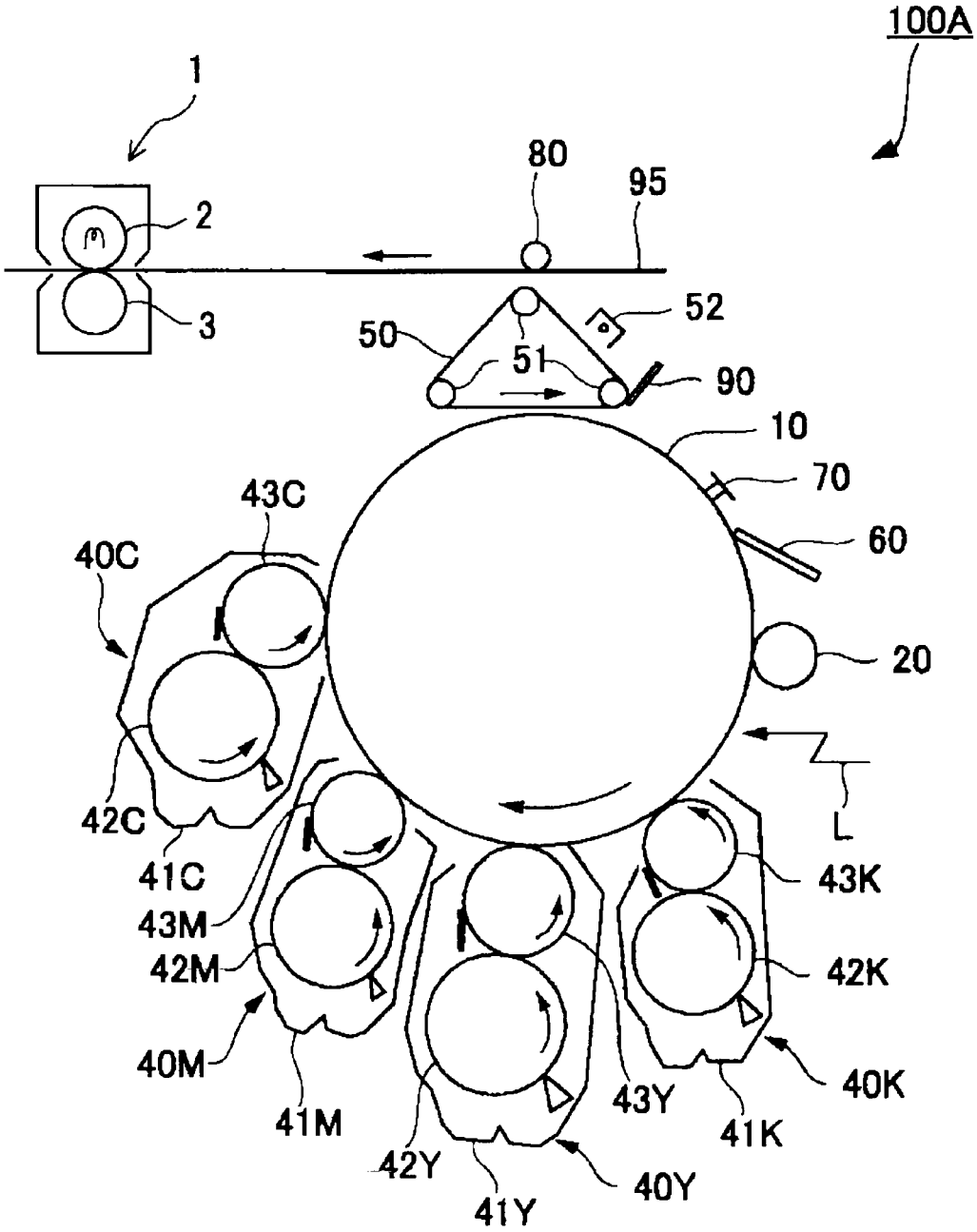
FIG. 1 is a schematic diagram showing one example of an image forming apparatus of the present embodiment.

A toner of the present invention contains a binder resin, a releasing agent, and a colorant, and if necessary other components.

The toner contains at least a crystalline polyester resin and a non-crystalline polyester resin as the binder resin. In the case where a volume average particle diameter of the toner is defined as Dv, the toner contains a group of the toner particles having the volume average particle diameter of 4/5Dv, and a group of the toner particles having the volume average particle diameter of 6/5Dv, and wherein an endothermic value A of the crystalline polyester resin at a first temperature increase in a differential scanning calorimetry of the toner, an endothermic value B of the crystalline polyester resin at a first temperature increase in a differential scanning calorimetry of the group of the toner particles having the volume average particle diameter of 4/5Dv after classification, and an endothermic value C of the crystalline polyester resin at a first temperature increase in a differential scanning calorimetry of the group of the toner particles having the volume average particle diameter of 6/5Dv after classification satisfy the relation represented by the following formulas:

$$50<(B/A)\times100<90 \text{ and } 110<(C/A)\times100<150.$$

With satisfying this relation, the amount of the crystalline polyester resin contained in the small toner particles decreases, and the amount of the crystalline polyester resin contained in the large toner particles increases. The decrease in the amount of the crystalline polyester resin in the small toner particles suppresses the degradation of heat resistant storage stability of the small toner particles, and the increase in the amount of the crystalline polyester resin in the large toner particles improves the effect of the low temperature fixing ability in the large toner particles. Thus, even though the toner containing the crystalline polyester resin has a particle size distribution to some extent, the toner has stable and suitable heat resistant storage stability and low temperature fixing ability as a whole. Hereinafter, the toner of the present invention will be specifically described.

The small toner particles are obtained by classifying the whole toner particles with a particle size distribution, so as to have a volume average particle diameter of 4/5Dv.

In the case where (B/A)×100 is 90 or more, the amount of the crystalline polyester resin increases in the small toner particles, and the crystalline polyester resin is easily exposed on the surface of the toner particle, causing degradation of the heat resistant storage stability. Thus, by decreasing the amount of the crystalline polyester resin contained in the toner particles, i.e., (B/A)×100 is less than 90, suitable heat resistant storage stability is obtained. However, in the case where (B/A)×100 is 50 or less, the amount of the crystalline polyester resin in the binder resin component excessively decreases, and the crystalline polyester resin becomes less compatible with the non-crystalline polyester resin, causing degradation of the low temperature fixing ability. Thus, it is necessary that (B/A)×100 is more than 50.

The large toner particles are obtained by classifying the whole toner particles with a particle size distribution, so as to have a volume average particle diameter of 6/5Dv.

In the case where (C/A)×100 is 110 or less in the large toner particles, the low temperature fixing ability degrades. Thus, by increasing the amount of the crystalline polyester resin contained in the toner particles, i.e., (C/A)×100 is more than 110, the low temperature fixing ability is secured. However, in the case where (C/A)×100 is 150 or more, the amount of the crystalline polyester resin contained in the toner particle excessively increases, and the crystalline polyester resin is easily exposed on the surface of the toner particle, causing degradation of the heat resistant storage stability. Thus, it is necessary that (C/A)×100 is less than 150. When the amount of the crystalline polyester resin excessively increases, and the crystalline polyester resin is easily exposed on the surface of the toner, filming easily occurs. Thus, by satisfying (C/A)×100 being less than 150, the filming can be suppressed.

Thus, by satisfying the relation represented by the formulas 50<(B/A)×100<90 and 110<(C/A)×100<150, the toner can have stable and suitable low temperature fixing ability and heat resistant storage stability as a whole. Moreover, the filming can be suppressed.

More preferably with satisfying the relation represented by the formulas 60<(B/A)×100<80 and 110<(C/A)×100<130, the above-described effect can be suitably obtained.

Moreover, when an exothermic value D of the releasing agent upon temperature decrease after the first temperature increase in the differential scanning calorimetry of the toner, an exothermic value E of the releasing agent upon temperature decrease after the first temperature increase in the differential scanning calorimetry of the group of the toner particles having the volume average particle diameter of 4/5Dv after classification, and an exothermic value F of the releasing agent upon temperature decrease after the first temperature increase in the differential scanning calorimetry of the group of the toner particles having the volume average particle diameter of 6/5Dv after classification satisfy the relation represented by the following formulas:

$$50<(E/D)\times 100<90 \text{ and } 110<(F/D)\times 100<150.$$

With satisfying this relation, the amount of the releasing agent contained in the small toner particles decreases, and the amount of the releasing agent contained in the large toner particles increases. The toner of the present invention contains a large amount of the crystalline polyester resin in the large toner particles as described above. However, the crystalline polyester resin is easily exposed on the surface of each toner particle, adversely affecting filming. Thus, the increase in the amount of the releasing agent in the large toner particles improves the effect of suitably suppressing the filming, even though the large toner particles contain a large amount of the crystalline polyester resin. Thus, the toner has stable low temperature fixing ability and heat resistant storage stability, and the filming can be suppressed.

The endothermic value of the crystalline polyester resin of the toner can be measured, for example, by the method described below using the DSC system (differential scanning calorimeter, Q-200, manufactured by TA INSTRUMENTS JAPAN INC.). At first, about 5.0 mg of a toner sample is weight and added to an aluminum sample container. The sample container is placed on a holder unit and set in an electric furnace. Next, in a nitrogen atmosphere (flow rate: 50 mL/min), the sample is heated from −20° C. to 150° C. at a temperature increasing rate of 1° C./min, temperature modulation cycle of 60 seconds, and temperature modulation amplitude of 0.159° C. Thereafter, the sample is cooled from 150° C. to 0° C. at a temperature decreasing rate of 10° C./min. In this process, the DSC curve of the sample is measured with a differential scanning calorimeter (Q-200, TA INSTRUMENTS JAPAN INC.). From the obtained DSC curve, the endothermic peak of the DSC curve corresponding to the crystalline polyester resin at the first temperature increase is selected, and an endothermic value is calculated. The exothermic value of the releasing agent is calculated by selecting the exothermic peak of the releasing agent at the temperature decrease.

An exemplary method for preparing the toner containing a small amount of the crystalline polyester resin in the small toner particles and a large amount of the crystalline polyester resin in the large toner particles, which satisfies the above-described relation, is as follows.

In the method for producing a toner in which an oil phase containing at least the crystalline polyester resin and the non-crystalline polyester resin as the binder resin component in the organic solvent is dispersed in the aqueous medium to obtain a dispersion liquid and the organic solvent is removed from the obtained dispersion liquid, the crystalline polyester resin is dissolved in the organic solvent as heated, and recrystallized as cooled, to thereby obtain a crystalline polyester dispersion liquid. The dispersed particle diameter of the crystalline polyester resin precipitated in the cooling process is determined depending on the cooling rate of the solution. When the cooling rate is fast, the resultant particle diameter is small, and when the cooling rate is slow, the resultant particle diameter is large. Moreover, after cooling, the particles of the crystalline polyester resin in the dispersion liquid are formed into fine particles with a mechanical pulverization device. The temperature of the dispersion liquid needs to be lower than the temperature of the crystalline polyester resin dissolved into the organic solvent (dissolution temperature). When the temperature of the dispersion liquid is close to the dissolution temperature, the dispersed crystalline polyester resin may be reaggregated in the dispersion liquid. The crystalline polyester resin can be finely dispersed in the dispersion liquid by keeping dispersion liquid temperature low. Meanwhile, the longer the dispersion time is, the more uniformly the dispersed particle diameter is formed. Thus, by changing the temperature profile, dispersion temperature, and dispersion time during the cooling process, the crystalline polyester resin contained in the toner can have a desired particle size distribution.

The finely dispersed crystalline polyester resin tends to be uniformly dispersed in the toner, regardless of the particle size of the toner. When the dispersed particle diameter of the crystalline polyester resin is 0.5 μm or larger, the dispersed crystalline polyester resin easily aggregates in the large toner particles. Particularly, when the proportion of the crystalline polyester resin having a dispersed particle diameter of 1.0 μm or larger is 23% or less, the amount of the crystalline polyester resin contained in the small toner particles is small, but the amount thereof contained in the large toner particles is large.

Here, the particle diameter of the crystalline polyester resin having a dispersed particle diameter of 1.0 μm or larger contained in the dispersion liquid is measured with LA920 (manufactured by Horiba, Ltd.). The type of a solvent to dilute the crystalline polyester resin is not particularly limited, as long as the crystalline polyester resin is sparingly soluble therein. For example, as the solvent, a mixture of N,N-dimethylformamide (DMF) and ethanol (DMF:ethanol=1:1) may be used. Specifically, a dispersion liquid is charged in the mixture of N,N-dimethylformamide (DMF) and ethanol (DMF:ethanol=1:1) so as to obtain the transmittance of 80%±1%, and dispersed by ultrasonic wave for 4 minutes, followed by measurement and calculation of a median size, and a proportion of particles having 1 μm or larger using a LA 920 system.

The dispersed particle diameter of the crystalline polyester resin in the toner particles is preferably 0.1 μm to 2.0 μm as a long axis from the stand point that the crystalline polyester resin is finely dispersed, and localized near the surface of each of the toner particles. When the dispersed particle diameter is smaller than 0.1 μm, the crystalline polyester dispersion liquid has high viscosity, and it is difficult to control the dispersed particle diameter to the ideal range, i.e. 0.1 μm to 2.0 μm. Moreover, the crystalline polyester resin is easily compatible with the non-crystalline polyester resin, possibly degrading heat resistant storage stability. When the dispersed particle diameter is larger than 2.0 μm, it is difficult to form toner particles. Therefore, dispersed particle diameter is preferably 2.0 μm or smaller.

The measurement method of the dispersed particle diameter of the crystalline polyester resin in the toner particles is not particularly limited, and the following method may be used: First, toner particles are embedded in an epoxy resin and it is cut out into an approximately 100 nm ultrathin section, and then stained with ruthenium tetroxide. Next, the stained sample is observed through a transmission electron microscope (TEM) at a magnification of 10,000×, and an image of TEM picture is evaluated. According to the above procedure, a dispersion state of the crystalline polyester resin is observed, and the dispersed particle diameter of the crystalline polyester resin can be measured. Specifically, long axes of 50 toner particles are measured, followed by obtaining an average dispersed particle diameter.

Next, the toner of the present invention will next be described in more detail.

The toner of the present invention will be described with reference to the specific examples of preferable materials of the toner, preferable materials used for producing the toner, and their preferable physical properties and production methods. Notably, the below-described embodiments are preferable embodiments of the present invention to which technically preferable limitations are imposed. However, the scope of the present invention should not be construed as being limited to these preferable embodiments, unless reference is made to limitation to the present invention.

The toner of the present invention is preferably produced by the method includes: dissolving or dispersing at least the colorant, the releasing agent, the crystalline polyester resin, a compound containing an active hydrogen group, a binder resin precursor having a portion reactive with the compound containing an active hydrogen group, and a binder resin component other than the foregoing in an organic solvent to obtain an oil phase; dispersing the oil phase in the aqueous medium containing a fine particle dispersant to obtain an emulsified dispersion liquid, allowing the binder resin precursor and the compound containing an active hydrogen group to undergo a crosslinking reaction, an elongation reaction, or both thereof in the emulsified dispersion liquid, and removing the organic solvent.

The binder resin contains a polyester resin because the suitable low temperature fixing ability of the toner is obtained, but the binder resin more preferably contains an unmodified polyester resin (a polyester resin that is not modified). Note that, the molecular weight, monomer unit, and the like of the polyester resin may be appropriately selected depending on the intended purpose. Moreover, the binder resin may further contain a resin other than the polyester resin. Examples of the resin other than the polyester resin include: homopolymers or copolymers of styrene-based monomers, acryl-based monomers, and methacryl-based monomers; and resins such as polyol resins, phenol resins, silicone resins, polyurethane resins, polyamide resins, furan resins, epoxy resins, xylene resins, terpene resins, coumarone-indene resins, polycarbonate resins, and petroleum resins. These may be used alone or in combination.

The glass transition temperature Tg of the binder resin is preferably 35° C. to 80° C., more preferably 40° C. to 75° C. from the standpoint of storage stability of the resultant toner. When Tg thereof is lower than 35° C., the resultant toner may be deteriorated when it is at the high temperature atmosphere, and moreover the resultant toner may easily cause offset at the time of fixing. When Tg thereof is higher than 80° C., the fixing ability of the resultant toner may be poor.

The binder resin preferably contains a polyester resin having a functional group reactive with the active hydrogen group (also referred to as "polyester prepolymer" hereinafter). As the polyester prepolymer, those having isocyanate groups can be used. Such the polyester prepolymer can be obtained, for example, through a reaction between an active hydrogen group-containing polyester resin and polyisocyanate.

The polyester resin is obtained through a dehydration condensation between polyhydric alcohol and polycarboxylic acid.

Examples of the polyhydric alcohol for use include dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and dihydric alcohols obtained by adding cyclic ether such as ethylene oxide and propylene oxide to hydrogenated bisphenol A or bisphenol A. For crosslinking the polyester resin, it is preferred that the trihydric or higher polyhydric alcohol be used in combination, and examples of such alcohol include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylol ethane, trimethylol propane, and 1,3,5-trihydroxybenzene.

Examples of the polycarboxylic acid include: benzene dicarboxylic acid such as phthalic acid, isophthalic acid, and terephthalic acid, and anhydrides thereof, alkyl dicarboxylic acid such as succinic acid, adipic acid, sebacic acid, and azelaic acid, and anhydrides thereof; unsaturated dibasic acid such as maleic acid, citraconic acid, itaconic acid, alkenyl succinic acid, fumaric acid, and mesaconic acid; unsaturated dibasic acid anhydrides such as maleic anhydride, citraconic anhydride, itaconic anhydride, and alkenyl succinic anhydride; trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetrakis(methylenecarboxy)methane, 1,2,7,8-octane tetracarboxylic acid, and ENPOL trimer acid, anhydride thereof, and partial lower alkyl esters thereof.

From the standpoint of the fixing ability and offset resistance of the resultant toner, the polyester resin has a THF insoluble component whose molecular weight preferably has at least one peak in the region of 3,000 to 50,000, more preferably in the region of 5,000 to 20,000 in its molecular weight distribution. Moreover, an amount of the THF insoluble component of the polyester resin having the molecular weight of 100,000 or lower is generally 60% by mass to 100% by mass. Note that, the molecular weight distribution of the polyester resin can be measured by means of gel permeation chromatography (GPC) using THF as an eluent.

Examples of the active hydrogen group contained in the polyester resin include hydroxyl groups (e.g., an alcoholic hydroxyl group and phenolic hydroxyl group), amino groups, carboxyl groups, and mercapto groups. Among them, the alcoholic hydroxyl group is preferably used.

It is preferred that at least part of the polyester resin and the polyester prepolymer be compatible to each other in view of low temperature fixing ability and anti offset resistance. Therefore, it is preferred that the formulation of the polyester resin and the formulation of the polyester prepolymer be similar.

Examples of the polyisocyanate include: aliphatic polyisocyanate (e.g., tetramethylene diisocyanate, hexamethylene diisocyanate, and 2,6-diisocyanate methyl caproate); alicyclic polyisocyanate (e.g. isophorone diisocyanate, and cyclohexylmehane diisocyanate); aromatic diisocyanate (e.g. tolylene diisocyanate, and diphenylmethane diisocyanate); aromatic aliphatic diisocyanate (e.g. $\alpha,\alpha,\alpha',\alpha'$-tetramethyl xylylene diisocyanate); and isocyanurates. These may be used alone or in combination. Moreover, as the polyisocyanate, those blocked with phenol derivatives, oxime, caprolactam, or the like may be used.

When the polyester containing a hydroxy group and the polyisocyanate are reacted, an equivalent mass ratio of the isocyanate groups in the polyisocyanate to the hydroxy groups contained in the polyester containing a hydroxy group is generally 1 to 5, preferably 1.2 to 4, and even more preferably 1.5 to 2.5. When the ratio thereof is more than 5, the low temperature fixing ability of the toner may be degraded.

When the ratio thereof is less than 1, the urea content in the modified polyester resin obtained through a crosslinking and/or elongation reaction described below decreases, lowering the hot offset resistance of the resultant toner.

An amount of the constituent derived from the polyisocyanate in the polyester prepolymer is generally 0.5% by mass to 40% by mass, preferably 1% by mass to 30% by mass, and more preferably 2% by mass to 20% by mass. When the amount thereof is less than 0.5% by mass, the resultant toner has poor hot offset resistance, and may not be able to attain both the heat resistance storage stability and the low temperature fixing ability. When the amount thereof is more than 40% by mass, the low temperature fixing ability of the resultant toner may be poor.

The number (on average) of isocyanate groups per molecule of the polyester prepolymer is generally 1 or more, preferably 1.5 to 3, and even more preferably 1.8 to 2.5. When the number of the isocyanate group is less than 1, a molecular weight of the modified polyester resin after the crosslinking and/or elongation reaction decreases, possibly causing decrease in hot offset resistance of a resultant toner.

A mass ratio of the polyester resin to the polyester prepolymer is generally 5/95 to 50/50, preferably 10/90 to 30/70, and more preferably 12/88 to 25/75. When the mass ratio thereof is less than 5/95, the hot offset resistance of the resultant toner is poor, and the resultant toner may not be able to attain both the heat resistance storage stability and low temperature fixing ability. When the mass ratio thereof is more than 50/50, the low temperature fixing ability of the resultant toner may be poor.

It is preferred in the present invention that the polyester prepolymer and an active hydrogen group-containing compound (may also be referred to as "a crosslinking agent and/or elongation agent" hereinafter) be allowed to react (may also be referred to as "crosslinking and/or elongation reaction" hereinafter) in an aqueous medium.

As the crosslinking agent and/or elongation agent, amines can be used. Examples of the amines include divalent amine, tri or higher valent amine, amino alcohol, amino mercaptan, and amino acid. Examples of the divalent amines include: aromatic diamine (e.g. phenylene diamine, diethyl toluene diamine, and 4,4'-diaminodiphenyl methane); alicyclic diamine (e.g. 4,4'-diamino-3,3'-dimethyldichlorohexyl methane, diamine cyclohexane, and isophorone diamine); and aliphatic diamine (e.g. ethylene diamine, tetramethylene diamine, and hexamethylene diamine). Examples of the tri or higher valent amine include diethylene triamine, and triethylene tetramine. Examples of the amino alcohol include ethanol amine, hydroxyethyl aniline. Examples of the amino mercaptan include aminoethylmercaptan, and aminopropylmercaptan. Examples of the amino acid include amino propionic acid, and amino caproic acid. Moreover, as the amines, compounds in which amino groups are blocked may be used, and specific examples of such compounds include a ketimine compound, and an oxazolidine compound, both of which the amino group in the compound is blocked with ketones (e.g. acetone, methyl ethyl ketone, and methyl isobutyl ketone). Among them, the divalent amine, or a mixture of the divalent amine and a small amount of the tri or higher valent amine is preferable.

Moreover, a molecular weight of the modified polyester resin may be controlled, if necessary, using a terminator during the crosslinking and/or elongation reaction. Examples of the terminator include: monoamines (e.g. diethylamine, dibutylamine, butylamine, and laurylamine), and compounds in which an amino group of monoamine is blocked, for example, with ketones (e.g. acetone, methyl ethyl ketone, and methyl isobutyl ketone), such as ketimine compounds and oxazoline compounds.

For the crosslinking and/or elongation reaction, an equivalent mass ratio of the amino group contained in the amines to the isocyanate groups contained in the polyester prepolymer is preferably 1/3 to 3/1, more preferably 1/2 to 2/1, and even more preferably 2/3 to 3/2. When the equivalent mass ratio thereof is more than 3/1 or less than 1/3, the molecular weight of the resultant modified polyester resin is small, which may lead to poor hot offset resistance of the resultant toner.

Since the crystalline polyester resin contained in the toner has crystallinity, the resultant toner has thermofusion properties that the viscosity of the toner dramatically decreases at around the fixing onset temperature (fusion onset temperature) because of the crystallinity. Specifically, the toner has the suitable heat resistant storage stability just below the fusion onset temperature because of the crystallinity, and shows dramatic viscosity reduction (sharp melt) at the fusion onset temperature so as to be fixed. Thus, the toner having both excellent heat resistant storage stability and low temperature fixing ability can be designed. Moreover, it has been known that such the toner has also excellent releasing width (i.e. difference between the minimum fixing temperature and hot offset occurring temperature).

The crystalline polyester resin for use is appropriately selected depending on the intended purpose without any limitation, but it is preferably a polyester resin synthesized from an alcohol component containing a C2-C20 diol compound or derivatives thereof, and an acid component containing a polycarboxylic acid compound (e.g. aliphatic dicarboxylic acid, aromatic dicarboxylic acid, and alicyclic dicarboxylic acid) or derivatives thereof.

The crystalline polyester resin is synthesized, for example, using a C2-C12 saturated aliphatic diol compound as an alcohol component, in combination with at least C2-C12 dicarboxylic acid having a double (C═C) bond or C2-C12 saturated dicarboxylic acid as an acid component. Examples of the C2-C12 saturated aliphatic diol compound include 1,4-butanediol, 1,6-hexanediol, 1,8-octanediol, 1,10-decanediol, 1,12-dodecanediol, and derivatives thereof. Examples of the dicarboxylic acid include fumaric acid, 1,4-butanedioic acid, 1,6-hexanedioic acid, 1,8-octanedioic acid, 1,10-decanedioic acid, 1,12-dodecanedioic acid, and derivatives thereof. Among them, the crystalline polyester resin is preferably synthesized using the saturated C4-C12 diol component selected from 1,4-butanediol, 1,6-hexanediol, 1,8-octanediol, 1,10-decanediol, 1,12-dodecanediol, and the saturated C4-C12 dicarboxylic acid component selected from 1,4-butanedioic acid, 1,6-hexanedioic acid, 1,8-octanedioic acid, 1,10-decanedioic acid, 1,12-dodecanedioic acid is particularly preferable because the resulting crystalline polyester resin has high crystallinity and shows drastic viscosity change at around the melting point thereof.

The organic solvent used for dispersing the crystalline polyester resin is selected from those capable of completely dissolving the crystalline polyester resin therein to form an uniform solution, and can cause phase separation from the crystalline polyester resin as cooled to form a nonuniform opaque solution. Specifically, the organic solvent is selected from organic solvents exhibit nonsolvent properties at the temperature lower than (Tm-40)° C. based on the melting temperature (Tm) of the crystalline polyester resin, and exhibit properties of good solvent at the temperature equal to or higher than (Tm-40)° C., and examples thereof include toluene, ethyl acetate, butyl acetate, methyl ethyl ketone, and methyl isobutyl ketone. These may be used alone or in combination.

(Method for Producing Toner)

The toner of the present invention can also be produced by the method including: dispersing a crystalline polyester resin and a non-crystalline polyester resin respectively in separate aqueous media to form crystalline polyester resin particles and non-crystalline polyester resin particles to thereby emulsify (emulsification step); mixing the resin particles, a releasing agent dispersion liquid, and a colorant dispersion liquid to thereby prepare a dispersion liquid containing aggregated particles (aggregation step); heating the dispersion liquid containing aggregated particles to the temperature equal to or higher than the glass transition temperature of the resin particles to thereby fuse the aggregated particles into toner particles (fusing step); and washing the toner particles (washing step). One example of such the method will be explained hereinafter.

<Emulsification Step>

The formation of the crystalline polyester particles can be carried out, for example, by applying a shear force to the solution, in which the aqueous medium and the crystalline polyester resin are mixed, by means of a disperser. At this time, heat may be applied for reducing the viscosity of the resin component to form particles. Moreover, a dispersant may be used for stabilizing the dispersed resin particles. Furthermore, in the case where the resin is soluble in a solvent forming an oil phase, and having the relatively low solubility to water, the resin is made dissolved in such the solvent to form an oil phase, and the oil phase is dispersed into particles in water together with a dispersant or polyelectrolyte, and the solvent is evaporated and removed by heating or reducing pressure to thereby prepare a dispersion liquid of the crystalline polyester particles. A dispersion liquid of the non-crystalline polyester resin particles is also prepared in the same manner as described above.

Examples of the aqueous medium include: water such as distilled water and ion-exchanged water; and alcohols, but the aqueous medium is preferably water. The disperser for use in the emulsifying step is, for example, a water-soluble polymer such as polyvinyl alcohol, methyl cellulose, ethyl cellulose, hydroxyethyl cellulose, carboxymethyl cellulose, sodium polyacrylate, and sodium polymethacrylate; an anionic surfactant such as sodium dodecylbenzenesulfonate, sodium octadecylsulfate, sodium oleate, sodium laurate, and potassium stearate; a cationic surfactant such as laurylamine acetate, stearylamine acetate, and lauryltrimethyl ammonium chloride; an amphoteric surfactant such as lauryldimethyl amine oxide; a nonionic surfactant such as polyoxyethylene alkyl ether, polyoxyethylene alkylphenyl ether, and polyoxyethylene alkyl amine; an inorganic salt such as tricalcium phosphate, aluminum hydroxide, calcium sulfate, calcium carbonate, and barium carbonate; or the like.

The dispersing method of the emulsion is, for example, dispersing the emulsion by means of a disperser, and examples of the disperser include a homogenizer, a homomixer, a pressure kneader, an extruder, and a media disperser. The size of the resin particles is preferably the average particle diameter (volume average particle diameter) of 0.01 μm to 1.0 μm.

The dispersing method of the colorant is not particularly limited, and is, for example, a commonly known dispersion method by means of a rotary shear homogenizer, or a ball mill, sand mill or Dyno-mill having a media.

If necessary, the aqueous dispersion liquid of the colorant may be prepared by using a surfactant, or an organic solvent-based dispersion liquid of the colorant may be prepared by using a dispersant. Such the dispersion liquid of the colorant may be referred to as a "colorant dispersion liquid" hereinafter. The surfactant or dispersant used for dispersing can be the dispersant that can be used for dispersing the crystalline polyester resin or the like.

An amount of the colorant to be added is preferably 1% by mass to 20% by mass, more preferably 1% by mass to 10% by mass, even more preferably 2% by mass to 10% by mass, and particularly preferably 2% by mass to 7% by mass, relative to the total amount of the polymer.

In the case where the colorant is added and mixed in the emulsification step, mixing of the polymer and the colorant can be carried out by mixing the colorant or an organic solvent-based dispersion liquid of the colorant to the organic solvent solution of the polymer.

<Aggregation Step>

During the aggregation step, the obtained crystalline polyester resin particle dispersion liquid, non-crystalline polyester resin particle dispersion liquid, the colorant dispersion liquid, and the like are mixed to form a liquid mixture, and the liquid mixture is heated at the temperature equal to or lower than the glass transition temperature of the non-crystalline polyester resin to cause aggregation, to thereby form aggregated particles. The formation of the aggregated particles is carried out by adjusting the pH of the liquid mixture to become acid with stirring. The pH is preferably in the range of 2 to 7, more preferably 2.2 to 6, and even more preferably 2.4 to 5. For this process, use of an aggregating agent is also effective.

The aggregating agent for use is preferably a surfactant having a reverse polarity to that of the surfactant used as the dispersant, an inorganic metal salt, or a divalent or higher valent metal complex. Use of the metal complex is particularly preferable as an amount of the surfactant for use is reduced, and the charging ability improves.

Examples of the inorganic metal salt include: metal salts such as calcium chloride, calcium nitrate, barium chloride, magnesium chloride, zinc chloride, aluminum chloride, and aluminum sulfate; and organic metal salt polymers such as polyaluminum chloride, polyaluminum hydroxide, and calcium polysulfide. Among them, aluminum salts and polymers thereof are particularly preferable. To attain the sharper particle size distribution, the valence of the inorganic metal salt is more preferably bivalence over monovalence, trivalence over bivalence, tetravalence over trivalence.

<Toner Particles Producing Step>

In the step of producing the toner particles, it is preferred that only the resin particle dispersion liquid be added to the aggregation system to aggregate resin particles to each other, and then the dispersion liquid of the colorant or releasing agent be added. In this manner, any interference in aggregation of resin particles due to the presence of releasing agent particles and the like can be avoided, and toner particles of the desirable structures can be effectively formed. The toner having a structure that a surface of the aggregated particles serving as a core is covered with the non-crystalline polyester resin may be produced by further adding the non-crystalline polyester resin particles to the aggregated particles which have been formed to have desirable particle diameters. In this case, the non-crystalline polyester resin particles added are preferably non-crystalline polyester resin particles having high molecular weight because the crystalline polyester resin is secured within the toner without easily being exposed on the surface of the toner particle. In the case where the non-crystalline polyester resin particles are further added, the aggregating agent may be added, or pH adjustment may be performed before adding the non-crystalline polyester resin particles. Moreover, when the crystalline polyester resin and the releasing agent are not added at the beginning of aggregation, but added after the particles are started to grow, the crystalline polyester resin and the releasing agent are likely not to be contained in the small toner particles. The later the timing of adding the crystalline polyester resin and the releasing agent is, the smaller the values of (B/A)×100 and (E/D)×100 become. In this manner, the toner can be prepared so as to contain the crystalline polyester resin and the releasing agent less in the small toner particles, but more in the large toner particles.

The volume-average particle diameter Dv of the resulting toner is preferably 4 μm to 7 μm, and more preferably 4.5 μm to 6.5 μm.

A ratio (Dv/Dn) of the volume-average particle diameter Dv to the number average particle diameter Dn is preferably 1.10 to 1.25.

The volume-average particle diameter Dv of the toner is measured by a particle size analyzer (Multisizer III, manufactured by Beckman Coulter, Inc.) with an aperture diameter of 100 μM using analysis software (Beckman Coulter Multisizer 3 Version 3.51). More specifically, 0.5 mL of 10% by mass surfactant (NEOGEN SC-A, alkylbenzenesolfonate, manufactured by Dai-ichi Kogyo Seiyaku Co., Ltd.) is placed in a 100-mL glass beaker, 0.5 g of each toner was added in the beaker and mixed together using a microspatula, and 80 mL of ion-exchanged water is added. The resultant dispersion liquid is subjected to dispersing treatment for 10 minutes with W-113MK-II, an ultrasonic disperser manufactured by HONDA ELECTRONICS Co., Ltd. For analysis, the dispersion liquid is measured using Multisizer III and ISOTON III (manufactured by Beckman Coulter Inc.) as a measurement solution.

In the case where the resin fine particles are heated equal to or higher than the glass transition temperature thereof so as to fuse the aggregated particles, progression of the aggregation is stopped by increasing the pH of the suspension liquid of the aggregated particles to the range of 3 to 9 with stirring in the same stirring conditions as in the aggregation step, and the aggregated particles are fused together by heating at the temperature equal to or higher than the Tg of the non-crystalline polyester resin having a high molecular weight or Tm of the crystalline polyester resin. The duration for the heating may be the duration long enough to fuse the aggregated particles, and may be 0.5 hours to 10 hours. After the fusing, the particles are cooled to thereby obtain fused particles.

<Washing Step>

The washing step is a step of washing the tone particles. The fused particles obtained through the fusing become toner particles through a solid-liquid separation process such as filtration, and optionally a washing step and drying step. As mentioned above, the particles are fused by heating to the temperature equal to or higher than the glass transition temperature. In the case the crystalline polyester resin and the non-crystalline polyester resin are used, part thereof is melted together at the time of the fusing, and therefore annealing may be performed during the toner production step. The annealing can be performed before or during the washing step, moreover, during the drying step or after the drying step.

(Developer)

The developer of the present invention contains the toner of the present invention, and may further contain other components such as a carrier, and the developer of the present invention can be used as a one-component developer containing the toner, or a two-component developer containing the toner and the carrier. Use of the developer of the present invention as the two-component developer is preferable from the standpoint of its long service life or the like when used in a high-speed printer and the like corresponding to the recent increased speed in information processing. The developer can be used in various electrophotographic methods known in the art, such as a magnetic one-component developing method, a non-magnetic one-component developing method, and a two-component developing method.

<One-component Developer>

When the developer of the present invention is used as a one-component developer, a change in the particle diameters of the toner is small even after supplying the toner to compensate the consumed amount, filming of the toner to a developing roller and fusion of the toner to members such as a blade for forming the mass of the toner into a thin layer can be prevented, and desirable and stable developing ability can be attained even after long-time use of the developing device (i.e., long-time stirring of the developer).

<Two-component Developer>

When the developer of the present invention is used as a two-component developer, a change in the particle diameters of the toner is small even after supplying the toner to compensate the consumed amount over a long period of time, and desirable and stable developing ability can be attained even after stirring the developer for a long period of time in a developing device. An amount of the carrier in the two-component developer is preferably 90% by mass to 98% by mass, more preferably 93% by mass to 97% by mass.

—Carrier—

The carrier is not particularly limited, but it is preferred that the carrier contain a core and a resin layer covering the core.

—Core—

The material of the core is, for example, a manganese-strontium based material of 50 emu/g to 90 emu/g, a manganese-magnesium based material of 50 emu/g to 90 emu/g, or the like, and two or more of these materials may be used in combination. High magnetic materials such as the iron of 100 emu/g or higher, and the magnetite of 75 emu/g to 120 emu/g are preferably used as the core for securing the desirable image density. Moreover, a weak magnetic material such as a cupper-zinc (Cu—Zn) based material of 30 emu/g to 80 emu/g is preferable because the resultant carrier enables to reduce the impact to the photoconductor, on which developer particles are held in an upright position, and therefore it is advantageous for forming high quality images.

The volume average particle diameter ($D_{50}$) of the core is appropriately selected depending on the intended purpose without any limitation, but it is preferably 10 μm to 150 μm, more preferably 20 μm to 80 μm. When $D_{50}$ thereof is smaller than 10 μm, the proportion of the fine particles in the particle size distribution of the carrier increases, and therefore the magnetization per carrier particle is small, which may cause scattering of the carrier. When $D_{50}$ thereof is larger than 150 μm, the specific area of the resultant particle of the carrier is small, which may cause scattering of the carrier. Use of the core in such the size may lower the reproducibility of an image especially in a solid part, when a full color image having a large area of the solid image part is printed.

—Resin Layer—

Examples of the material of the resin layer include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer (e.g. a terpolymer of tetrafluoroethylene, vinylidene fluoride, and non-fluoride monomer), and a silicone resin. Two or more of them may be used in combination.

Examples of the amino-based resin include a urea-formaldehyde resin, a melamine resin, a benzoguanamine resin, a urea resin, a polyamide resin, and an epoxy resin. Examples of the polyvinyl-based resin include an acryl resin, polymethyl methacrylate, polyacrylonitrile, polyvinyl acetate, polyvinyl alcohol and polyvinyl butyral. Examples of the polystyrene-based resin include polystyrene, and a styrene-acryl copolymer. Examples of the halogenated olefin resin include polyvinyl chloride. Examples of the polyester-based resin include polyethylene terephthalate, and polybutylene terephthalate.

Moreover, the resin layer may contain conductive powder, if necessary. Examples of the material of the conductive powder include metal, carbon black, titanium oxide, tin oxide and zinc oxide. The average particle diameter of the conductive powder is preferably 1 μm or smaller. When the average particle diameter thereof is larger than 1 μm, it may be difficult to control the electric resistance.

The resin layer can be formed, for example, by preparing a coating liquid by dissolving a silicone resin or the like in a solvent, applying the coating liquid onto the surface of the core by the conventional coating method, drying and baking the coating liquid. Examples of the coating method include dip coating, spray coating, and brush coating. Examples of the solvent include toluene, xylene, methyl ethyl ketone, methyl isobutyl ketone, and butyl cellosolve acetate. Moreover, the baking method may be of external heating or internal heating, and examples of the baking method include methods using a fixed-type electric furnace, a flow-type electric furnace, a rotary electric furnace, a burner furnace, or micro waves.

An amount of the resin layer in the carrier is preferably 0.01% by mass to 5.0% by mass. When the amount of the resin layer in the carrier is less than 0.01% by mass, it may be difficult to form a uniform resin layer on the surface of the core. When the amount thereof is more than 5.0% by mass, the resin layer becomes excessively thick, the particles of the resultant carrier may cause aggregations, and therefore uniform particles of the carrier may not be obtained.

(Developer Container)

The developer container includes a container and the developer of the present invention housed in the container. The container is appropriately selected from those known in the art without any limitation, and examples thereof include a container including a container main body and a cap.

The size, shape, structure, material, and the like of the container main body is not particularly limited, but the shape thereof is preferably a cylinder, or the like, and more preferably a cylinder in which a convex-concave pattern is provided in spiral on the internal perimeter surface of the cylinder so that the contents, i.e. the developer, can be transported to the side of the discharging outlet by rotating, and part of or the entire spiral convex-concave pattern functions as bellows. Moreover, the material of the container main body is not particularly limited, but it is preferably a material giving the dimensional accuracy. Examples of such the material include resinous materials such as a polyester resin, a polyethylene resin, a polypropylene resin, a polystyrene resin, a polyvinyl chloride resin, polyacrylic acid, a polycarbonate resin, an ABS resin, and a polyacetal resin.

The developer container is easy to store, transport, and the like, and is excellent in handling. Therefore, the developer container can be detachably mounted in the below-mentioned process cartridge, image forming apparatus, and the like, and used for supplying the developer.

(Image Forming Apparatus and Image Forming Method)

The image forming method of the present invention includes at least a latent electrostatic image forming step, a developing step, a transferring step, and a fixing step, preferably further includes a cleaning step, and optionally may further include, for example, a diselectrification step, a recycling step, and a controlling step.

The image forming apparatus of the present invention preferably contains at least a latent electrostatic image bearing member, a latent electrostatic image forming unit, a developing unit, a transfer unit, and a fixing unit, more preferably further contains a cleaning unit, and optionally may further contain, for example, a diselectrification unit, a recycling unit, and a controlling unit.

The image forming method of the present invention can be carried out by means of the image forming apparatus of the present invention, the latent electrostatic image forming step can be carried out with the latent electrostatic image forming unit, the developing step can be carried out with the developing unit, the transferring step can be carried out with the transfer unit, the fixing step can be carried out with the fixing unit, and other steps mentioned above can be carried out with other units mentioned above.

<Latent Electrostatic Image Forming Step>

The latent electrostatic image forming step is forming a latent electrostatic image on the latent electrostatic image bearing member such as a photoconductive insulator, a photoconductor and the like. The material, shape, structure, size and the like of the latent electrostatic image bearing member are appropriately selected from those known in the art without any limitation, but the shape thereof is preferably a drum shape. Moreover, examples of the photoconductor include: an inorganic photoconductor such as amorphous silicon, and selenium; and an organic photoconductor such as polysilane, and phthalopolymethine. Among them, the amorphous silicon photoconductor is preferable as it has a long service life.

A latent electrostatic image can be formed, for example, by uniformly charging the surface of the latent electrostatic image bearing member, and exposing imagewise the charged surface of the latent electrostatic image bearing member to light, and the latent electrostatic image can be formed by using the latent electrostatic image forming unit. The latent electrostatic image forming unit includes, for example, at least a charging unit configured to apply a voltage to the surface of the latent electrostatic image bearing member to uniformly charge the surface of the latent electrostatic image bearing member, and an exposing unit configured to expose imagewise the surface of the latent electrostatic image bearing member to light.

The charging unit is not particularly limited, and examples thereof include a conventional contact chargers known in the art equipped with a conductive or semiconductive roller, brush, film, rubber blade, or the like, and conventional non-contact charger using corona discharge such as corotron and scorotron.

The exposing unit is not particularly limited, as long as it is capable of exposing imagewise the charged surface of the latent electrostatic image bearing member by the charging unit to light, and examples thereof include various exposing devices such as a copying optical exposing device, a rod-lens array exposing device, a laser optical exposing device, and a liquid crystal shutter optical device. Note that, a photo-image black irradiation electrophotographic system in which exposure is performed imagewise from the back surface of the latent electrostatic image bearing member may be applied for the exposure.

<Developing Step>

The developing step is developing the latent electrostatic image with the toner to form a toner image, and a visible image (i.e. the toner image) can be formed with the developing unit. The developing unit is not particularly limited, as long as it is capable of performing development using the developer of the present invention. For example, the one at least having a developing device housing the developer of the present invention, and capable of providing a toner to the latent electrostatic image in a contact or non-contact manner can be used as the developing unit, and the developing unit is preferably a developing device equipped with the developer container. The developing unit may employ a dry developing system, or wet developing system, and may be a developing unit for a single color, or a developing unit for a multi-color. Examples of the developing device include a device having a stirrer configured to charge the developer of the present invention by frictions from stirring, and a rotatable magnetic roller. In the developing unit, for example, the toner and the carrier are mixed and stirred, and the toner is charged by the friction from the stirring. The charged toner is held on the surface of the rotatable magnetic roller in an upright position to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developed with the toner to form a toner image on the surface of the latent electrostatic image bearing member. Note that, the developer housed in the developing unit is the developer of the present invention, but it may be a one-component developer or two-component developer.

<Transferring Step>

The transferring step is charging the latent electrostatic image bearing member, on which the toner image has been formed, for example, by means of a transfer charging unit, to transfer the toner image to a recording medium, and the transferring step can be carried out by the transfer unit. The transferring step preferably includes a primary transferring step and a secondary transferring step, where the primary transferring step is transferring the toner image to an intermediate transfer medium, and the secondary transferring step is transferring the toner image transferred to the intermediate transfer medium to a recording medium. Moreover, the more preferable embodiment of the transferring step includes a primary transferring step and a secondary transferring step where the primary transferring step is transferring toner images, which have been formed with the toners of two or more colors, preferably full color, are respectively transferred to an intermediate transfer medium to form a composite toner image, and the secondary transferring step is transferring the composite toner image formed on the intermediate transfer medium to a recording medium.

The transfer unit preferably includes a primary transfer unit configured to transfer a toner image to an intermediate transfer medium to form a composite toner image, and a secondary transfer unit configured to transfer the composite toner image formed on the intermediate transferring medium to a recording medium. The intermediate transfer medium is not particularly limited, and examples thereof include an endless transfer belt. Moreover, the transfer unit (the primary transfer unit, the secondary transfer unit) preferably includes at least a transferrer configured to charge and release the toner image formed on the latent electrostatic image bearing member to the side of the recording medium. Note that, the transfer unit may contain one charger, or a plurality of chargers.

Examples of the transferrer include a corona transferrer utilizing corona discharge, a transfer belt, a transfer roller, a pressure transfer roller, and an adhesion transferrer.

The recording medium is appropriately selected from recording media (recording paper) known in the art without any limitation.

<Fixing Step>

The fixing step is fixing the toner image transferred to the recording medium, and the fixing can be performed by means of the fixing unit. In the case where the toners of two or more colors are used, fixing may be performed every time when the toner of each color is transferred to the recording medium. Alternatively, fixing may be performed after the toners of all the colors are transferred to the recording medium in a laminated state. The fixing unit is not particularly limited, and conventional heating pressurizing members known in the art can be used as the fixing unit. Examples of the heating and pressurizing unit include a combination of a heat roller and a pressure roller, and a combination of a heat roller, a pressure roller, and an endless belt. The heating temperature is generally 80° C. to 200° C. Note that, if necessary in combination with the fixing unit, an optical fixing unit known in the art may be used.

Conventionally, when such heat fixation method is used, half or more of electrical power consumption in an image forming apparatus is consumed for heat treatment of a toner in the fixing device using the heat fixation method. On the other hand, from the standpoint of countermeasures for environmental problems in recent years, image forming apparatuses of low power consumption (energy saving) are demanded.

In International Energy Agency (IEA) Demand-Side Management (DSM) program of 1999, there is a technology demanding project for photocopying machines of next generation, and demanded specifications are disclosed. Photocopying machines of 30 cpm or more are demanded to have a stand-by time of 10 seconds or shorter, and power consumption of 10 W to 30 W (varies depending on the printing speed) during the stand-by, and to achieve significant energy saving compared to the conventional photocopying machines. Therefore, it is necessary to save energy in a fixing device which consumes a large electric power.

In order to achieve the demands mentioned above and shorten the stand-by time, it is considered that reduction of fusion onset temperature of the toner and reduction of fixing temperature during the use of the toner are essential technical subject to be achieved. To achieve such low temperature fixing, the image forming apparatus of the present invention uses the toner of the present invention.

Moreover, in the fixing device, improvement for energy saving is promoted. Among the heat fixation method, a method for fixing by pressing a heat roller directly against a toner image on a recording medium, namely, a heat roller fixing system, has been widely used as it has excellent heat efficiency. Moreover, a method of improving thermal response of a toner by reducing a thermal capacity of a heat roller may be used. Since the specific heat capacity is small, however, a temperature difference between the area where the recording medium has been passed, and the area where the recording medium has not been passed becomes large, which causes toner depositions on the fixing roller. Therefore, after the fixing roller is rotated once, the toner is deposited on a non-imaging part of the recording medium, i.e. hot offset occurs. Therefore, demands for the toner to achieve hot offset resistance, as well as low temperature fixing ability, have been stricter. Therefore, the toner of the present invention, which can having both excellent low temperature fixing ability and heat resistant storage stability, is used.

<Diselectrification Step>

The diselectrification step is applying diselectrification bias to the latent electrostatic image bearing member to diselectrify the latent electrostatic image bearing member, and the diselectrification step can be carried out with the diselectrification unit. The diselectrification unit is not particularly limited, as long as it is capable of applying diselectrification bias to the latent electrostatic image bearing member, and examples thereof include a charge eliminating lamp.

<Cleaning Step>

The cleaning step is removing the residual toner on the latent electrostatic image bearing member, and the cleaning step can be carried out with the cleaning unit. The cleaning unit is not particularly limited, as long as it is capable of removing the residual toner on the latent electrostatic image bearing member, and examples thereof include a magnetic brush cleaner, an electrostatic brush cleaner, a magnetic roller cleaner, a blade cleaner, a brush cleaner, and a web cleaner.

<Recycling Step>

The recycling step is recycling the toner removed in the cleaning step to the developing unit, and the recycling can be carried out by the recycling unit. The recycling unit is not particularly limited, and as the recycling unit, conventional conveying units, and the like can be used.

<Controlling Step>

The controlling step is controlling operation of each step, and the controlling can be performed by the controlling unit. The controlling unit is appropriately selected depending on the intended purpose without any limitation as long as it is capable of controlling operations of each unit (i.e. each device), and examples thereof include a sequencer, and a computer.

One example of the image forming apparatus of the present invention is shown in FIG. 1. An image forming apparatus 100A is equipped with a photoconductor drum 10 as the latent electrostatic image bearing member, a charge roller 20 as the charging unit, an exposing device (not shown) as the exposing unit, a developing device 40 K, Y, M, C as the developing unit, an intermediate transfer medium 50, a cleaning device 60 having a cleaning blade as the cleaning unit, a charge eliminating lamp 70 as the diselectrification unit, and a fixing device 1 as the fixing unit.

The intermediate transfer medium 50 is an endless belt, and stretched around three rollers 51 placed inside the belt and designed to be moveable in the direction shown with the arrow. Part of the three rollers 51 also function as a transfer bias roller capable of applying a transfer bias (primary transfer bias), to the intermediate transfer medium 50. A cleaning device 90 containing a cleaning blade is provided near the intermediate transfer belt 50. A transfer roller 80, which is capable of applying a transfer bias for transferring a toner image onto recording paper 95 (secondary transfer), is provided so as to face to the intermediate transfer medium 50. In the surrounding area of the intermediate transfer medium 50, a corona charger 52 for supplying an electrical charge to the toner image on the intermediate transfer medium 50 is provided between contact area of the photoconductor drum 10 and the intermediate transfer medium 50, and contact area of the intermediate transfer medium 50 and recording paper 95.

The developing device 40 of each color of black (K), yellow (Y), magenta (M), and cyan (C) is equipped with a developer container 41, a developer feeding roller 42, and a developing roller 43 of each color of black (K), yellow (Y), magenta (M), and cyan (C). The fixing device 1 includes a heat roller 2 and a pressure roller 3.

In the image forming apparatus 100A, a surface of the photoconductor drum 10 is uniformly charged using the charging roller 20, and exposure light L is applied to the photoconductor drum 10 using the exposing device (not shown) to form a latent electrostatic image. Next, the latent electrostatic image formed on the photoconductor drum 10 is then developed with the toner fed from each of the developing device 40 K, Y, M, C to form a toner image. The toner image formed on the photoconductor drum 10 is transferred (primary transfer) onto the intermediate transfer medium 50 by a transfer bias applied from the supporting roller 51. Moreover, charge is applied to the toner image on the intermediate transfer medium 50 by a corona charger 52, and then the toner image is transferred onto the recording paper 95 (secondary transfer). The recording paper 95, on which the toner image has been transferred, is pressed and heated by the heat roller 2 and the pressure roller 3 of the fixing device 1, and the toner image is heated and melted, to thereby be fixed on the recording paper 95. While the toner remained on the photoconductor drum 10 is then removed by the cleaning device 60, and the charge built up over the photoconductor drum 10 is temporarily removed by the charge eliminating lamp 70.

Figure 2:
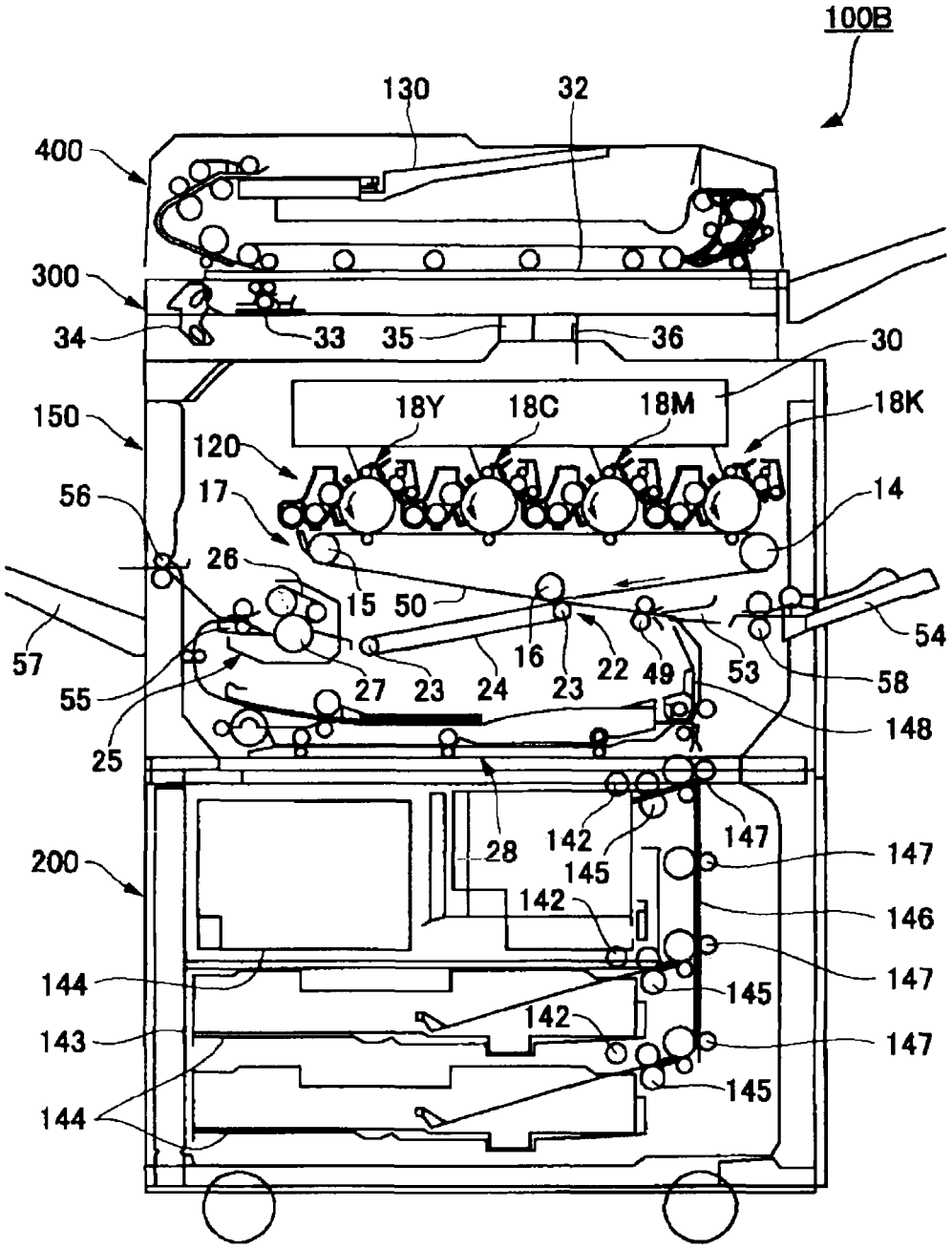
FIG. 2 is a schematic diagram showing another example of the image forming apparatus of the present embodiment.

Another example of the image forming apparatus of the present invention is shown in FIG. 2. The image forming apparatus 100B is a tandem-type color image forming apparatus, and contains a copier main body 150, a paper feeder table 200, a scanner 300, and an automatic document feeder (ADF) 400.

To the copier main body 150, an intermediate transfer medium 50 of an endless belt is provided at the center part thereof. The intermediate transfer medium 50 is stretched around three supporting rollers 14, 15, and 16 and is configured to rotate in the direction shown with the arrow. A cleaning device 17 for cleaning the residual toner on the intermediate transfer medium 50 is provided adjacent to the supporting roller 15. Moreover, a tandem developing unit 120 in which four image forming units 18 including of yellow, cyan, magenta, and black (18Y, 18C, 18M, 18K) are aligned along with the rotational direction of the intermediate transfer medium 50 faces the intermediate transfer medium 50 supported with the supporting rollers 14 and 15.

Figure 3:
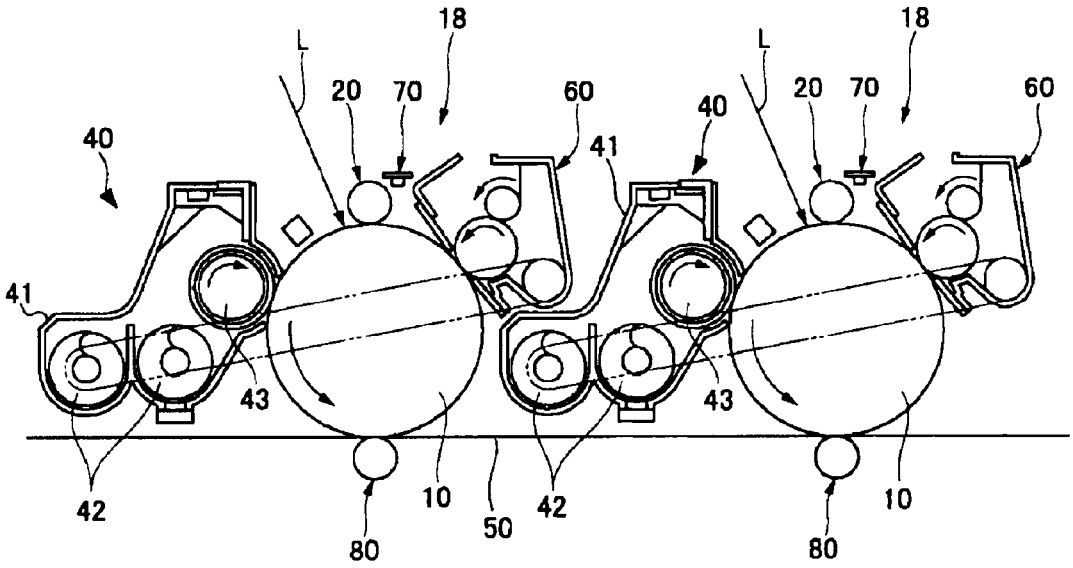
FIG. 3 is a schematic diagram showing the tandem developing unit of FIG. 2.

The image forming units 18 of each color is, as shown in FIG. 3, equipped with a photoconductor drum 10, a charging roller 20 for uniformly charging the photoconductor drum 10, a developing device 40 for developing a latent electrostatic image formed on the photoconductor drum 10 with a developer of each color of, yellow (Y), cyan (C), magenta (M), and black (K) to form a toner image, a transfer roller 80 for transferring the toner image of each color onto an intermediate transfer medium 50, a cleaning device 60, and a charge-eliminating lamp 70.

Moreover, the exposing device 30 is provided adjacent to the tandem-type developing unit 120. The exposing device 30 applies exposure light L onto the photoconductor drum 10 to form a latent electrostatic image thereon.

Moreover, a secondary transfer device 22 is provided to the opposite side of the intermediate transfer medium 50 to the side thereof where the tandem-type developing unit 120 is provided. The secondary transfer device 22 is consisted of a secondary transfer belt 24 that is an endless belt starched around a pair of supporting rollers 23, and is configured so that the recording paper conveyed on the secondary transfer belt 24 and the intermediate transfer medium 50 can be in contact with each other.

A fixing device 25 is provided adjacent to the secondary transfer device 22. The fixing device 25 includes a fixing belt 26 that is an endless belt, and a pressure roller 27 provided in the manner that the pressure roller 27 is pressed against the fixing belt 26. Of the rollers, around which the fixing belt 26 is stretched, one is a heat roller. Furthermore, a sheet reverser 28 for reversing the recording paper for forming images on the both sides of the paper is provided near the secondary transfer device 22 and the fixing device 25.

Formation of a full-color image (color copy) by the image forming apparatus 100B having the above described structure will be described next. Initially, a document is placed on a document platen 130 of the automatic document feeder (ADF) 400. Alternatively, the automatic document feeder 400 is opened, a document is placed on a contact glass 32 of the scanner 300, and the automatic document feeder 400 is closed. At the time of pushing a start switch (not shown), the document set in the automatic document feeder 400 is transported onto the contact glass 32, and then the document is scanned with a first carriage 33 and a second carriage 34. In the case where the document is initially placed on the contact glass 32, the scanner 300 is immediately driven to operate the first carriage 33 equipped and the second carriage 34 equipped. Light is applied from a light source of the first carriage 33 to the document, and reflected light from the document is further reflected at a mirror of the second carriage 34. Then, the light reflected at the mirror passes through an image forming lens 35 to reach a read sensor 36. In the manner as mentioned, the color document (color image) is read, and image information of each color of black, yellow, magenta, and cyan is obtained.

After forming a latent electrostatic image of each color on the photoconductor drums 10 Y, C, M, K by means of the exposing device 30 based on the obtained image information of each color, the latent electrostatic image of each color is developed with a developer supplied from each of the developing devices 40 Y, C, M, K to thereby form a toner image of each color. The formed toner images of respective colors are sequentially transferred (primary transfer) to the intermediate transfer medium 50 that is rotated by rollers 14, 15, and 16 to thereby form a composite toner image on the intermediate transfer medium 50.

One of feeding rollers 142 of the feeder table 200 is selectively rotated, recording paper is ejected from one of multiple feeder cassettes 144 in a paper bank 143 and are separated by a separation roller 145 one by one into a feeder path 146, are transported by a transport roller 147 into a feeder path 148 within the main body 150 and are bumped against a registration roller 49 to stop. Alternatively, recording paper is ejected recording paper from a manual-feeding tray 54, and separated by a separation roller 58 one by one into a feeder path 53, transported one by one and then bumped against the registration roller 49. Note that, the resist roller 49 is generally earthed, but it may be biased for removing paper dust of the recording paper.

The registration roller 49 is rotated synchronously with the movement of the composite toner image on the intermediate transfer body 50 to transport the recording paper into between the intermediate transfer body 50 and the secondary transfer device 22, and the composite toner image is transferred (secondary transferred) onto the recording paper.

The recording paper onto which the composite toner image has been transferred is conveyed by the secondary transfer device 22 to introduce into a fixing device 25. In the fixing device 25, the composite toner image is heated and compressed by a fixing belt 26 and a pressure roller 27 to fix onto the recording paper. Thereafter, the recording paper changes its traveling direction by action of a switch blade 55, is ejected by an ejecting roller 56 and is stacked on an output tray 57. Alternatively, the recording paper is changed its traveling direction by action of the switch blade 55, reversed by the sheet reverser 28, and lead again to a transfer position, and subjected to an image formation on the back surface thereof. The recording paper bearing images on both sides thereof is then ejected with assistance of the ejecting roller 56, and is stacked on the output tray 57.

Note that the residual toner on the intermediate transfer medium 50 is removed by the cleaning device 17 after the composite toner image is transferred.

(Process Cartridge)

The process cartridge used in the present invention is designed so that it is detachably mounted in various image forming apparatuses and includes at least a latent electrostatic image bearing member configured to bear a latent electrostatic image thereon, and a developing unit configured to develop with the developer of the present invention the latent electrostatic image on the latent electrostatic image bearing member. Note that, the process cartridge used in the present invention may further include other members, if necessary.

The developing unit includes a developer container in which the developer of the present invention is housed, and a developer bearing member configured to bear and convey the developer housed in the developer container. Note that, the developing unit may further include a regulating member for regulating a thickness of the developer borne.

Figure 4:
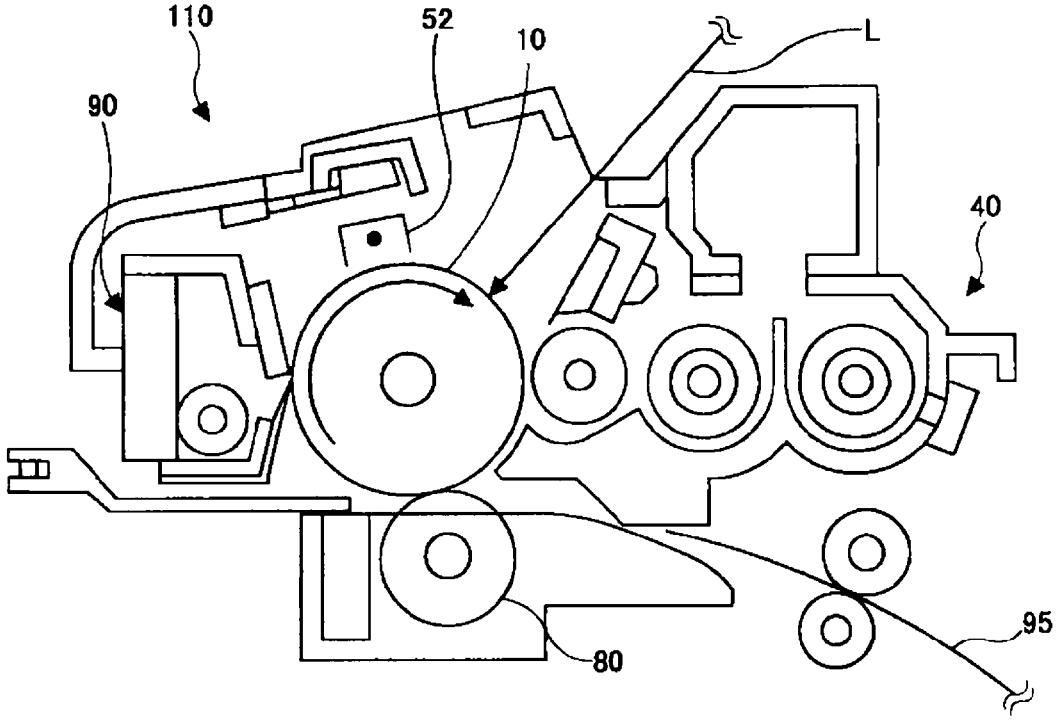
FIG. 4 is a schematic diagram showing one example of the process cartridge of the present embodiment.

One example of the process cartridge is shown in FIG. 4. The process cartridge 110 includes a photoconductor drum 10, a corona charger 52, a developing device 40, a transfer roller 80, and a cleaning device 90.

EXAMPLES

Examples of the present invention will be explained hereinafter, but these examples shall not be construed as limiting the scope of the present invention in any way. In the following examples, "part(s)" means "part(s) by mass."

Synthesis of Crystalline Polyester Resin

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 4.9 g of hydroquinone, and the mixture was allowed to react at 180° C. for 20 hours. Subsequently, the mixture was heated to 200° C. and allowed to react for 6 hours, followed by reacting for 10 hours at 8.3 kPa to thereby obtain Crystalline Polyester Resin 1.

Synthesis of Non-Crystalline Polyester (Low Molecular Weight Polyester) Resin

A 5 L four-neck flask equipped with a nitrogen-introducing pipe, a drainpipe, a stirrer and a thermocouple was charged with 229 parts of bisphenol A ethylene oxide 2 mole adduct, 529 parts of bisphenol A propylene oxide 3 mole adduct, 100 parts of isophthalic acid, 108 parts of terephthalic acid, 46 parts of adipic acid and 2 parts of dibutyl tin oxide. The mixture was allowed to react for 10 hours at 230° C. under normal pressure, and further reacted for another 5 hours under reduced pressure of 10 mmHg to 15 mmHg. After the reaction, 30 parts of trimellitic anhydride was added to the reaction container, and the mixture was allowed to react for 3 hours at 180° C. under normal pressure to thereby obtain Non-Crystalline Polyester Resin 1. The obtained Non-Crystalline Polyester Resin 1 had a number average molecular weight of 1,800, weight average molecular weight of 5,500, glass transition temperature Tg of 50° C., and acid value of 20 mgKOH/g.

Example 1

<Dissolution Suspension Method>

—Synthesis of Polyester Prepolymer—

A reaction container equipped with a condenser, a stirrer and a nitrogen-introducing pipe was charged with 682 parts of bisphenol A ethylene oxide 2 mole adduct, 81 parts of bisphenol A propylene oxide 2 mole adduct, 283 parts of terephthalic acid, 22 parts of trimellitic anhydride and 2 parts of dibutyl tin oxide. The resultant mixture was allowed to react under normal pressure at 230° C. for 8 hours and further react at a reduced pressure of 10 mmHg to 15 mmHg for 5 hours, to thereby produce Intermediate Polyester 1. The obtained Intermediate Polyester 1 had a number average molecular weight of 2,100, weight average molecular weight of 9,500, Tg of 55° C., acid value of 0.5 mgKOH/g and hydroxyl value of 51 mgKOH/g.

Next, a reaction container equipped with a condenser, a stirrer and a nitrogen-introducing pipe was charged with 410 parts of Intermediate Polyester 1, 89 parts of isophorone diisocyanate and 500 parts of ethyl acetate, followed by reaction at 100° C. for 5 hours, to thereby produce Prepolymer 1. The amount of free isocyanate contained in Prepolymer 1 was 1.53% by mass.

—Synthesis of Ketimine—

A reaction container equipped with a stirring rod and a thermometer was charged with 170 parts of isophorone diamine and 75 parts of methyl ethyl ketone, followed by reaction at 50° C. for 5 hours, to thereby produce Ketimine Compound 1. The amine value of Ketimine Compound 1 was 418.

—Synthesis of Master Batch (MB)—

Water (1,200 parts), carbon black (Printex 35, manufactured by Degussa) [DBP oil absorption amount=42 mL/100 mg, pH=9.5] (540 parts) and Non-Crystalline Polyester Resin 1 (1,200 parts) were mixed together with HENSCHEL MIXER (manufactured by Mitsui Mining Co., Ltd). The resultant mixture was kneaded at 150° C. for 30 minutes with a two-roller mill, and then rolled, cooled and pulverized with a pulverizer, to thereby produce Masterbatch 1.

—Preparation of Crystalline Polyester Dispersion Liquid—

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, 500 mL of glass beads (3 mm in diameter) were added to the mixture to perform pulverization with a batch-type sand mill (manufactured by Kanpe Hapio Co., Ltd.) at the average fluid temperature of 20° C. or lower for 10 hours, to thereby produce Crystalline Polyester Dispersion Liquid 1.

—Preparation of Oil Phase—

A container equipped with a stirring rod and a thermometer was charged with 378 parts of Non-Crystalline Polyester Resin 1, 110 parts of microcrystalline wax (Hi-Mic-1090, manufactured by Nippon Seiro Co., Ltd.), 22 parts of a charge controlling agent (CCA) (salycilic acid metal complex E-84, manufactured by Orient Chemical Industries, Ltd.) and 947 parts of ethyl acetate, and the mixture was heated to 80° C. under stirring. The resultant mixture was maintained at 80° C. for 5 hours and then cooled to 30° C. for 1 hour. Subsequently, the reaction container was charged with 500 parts of the masterbatch and 500 parts of ethyl acetate, followed by mixing the mixture for 1 hour, to thereby prepare Raw Material Solution 1.

The obtained Raw Material Solution 1 (1,324 parts) was poured into a container, and the carbon black and wax were dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 3 passes. Next, a 65% by mass ethyl acetate solution of Non-Crystalline Polyester Resin 1 (1,042.3 parts) was added thereto, and passed once with the bead mill under the above conditions, to thereby obtain Pigment-Wax Dispersion Liquid 1. The solid content of Pigment-Wax Dispersion Liquid 1 was 50% by mass (130° C., 30 minutes).

—Synthesis of Organic Particle Emulsion—

A reaction container equipped with a stirring rod and a thermometer was charged with 683 parts of water, 11 parts of a sodium salt of sulfuric acid ester of methacrylic acid-ethylene oxide adduct (ELEMINOL RS-30, manufactured by Sanyo Chemical Industries, Ltd.), 138 parts of styrene, 138 parts of methacrylic acid and 1 part of ammonium persulfate, and the resultant mixture was stirred at 400 rpm for 15 minutes to prepare a white emulsion. The obtained emulsion was heated to the internal system temperature of 75° C. and allowed to react for 5 hours. Subsequently, a 1% by mass aqueous ammonium persulfate solution (30 parts) was added to the reaction mixture, followed by aging at 75° C. for 5 hours, to thereby prepare an aqueous dispersion liquid of a vinyl resin (a copolymer of styrene/methacrylic acid/sodium salt of sulfuric acid ester of methacrylic acid ethylene oxide adduct), which was used as Fine Particle Dispersion Liquid 1. The prepared Fine Particle Dispersion Liquid 1 had a volume average particle diameter of 0.14 μm as measured with a particle size distribution analyzer (LA-920, manufactured by Horiba, Ltd.). Part of Fine Particle Dispersion Liquid 1 was dried to separate the resin.

—Preparation of Aqueous Phase—

Water (990 parts), 83 parts of Fine Particle Dispersion Liquid 1, 37 parts of a 48.5% aqueous solution of sodium dodecyldiphenyl ether disulfonate (ELEMINOL MON-7, manufactured by Sanyo Chemical Industries Ltd.) and 90 parts of ethyl acetate were mixed together and stirred to obtain an opaque white liquid, which was used as Aqueous Phase 1.

—Emulsification and Removal of Solvent (De-Solvent)—

In a container, 664 parts of Pigment-Wax Dispersion Liquid 1, 109.4 parts of Prepolymer 1, 73.9 parts of Crystalline Polyester Dispersion Liquid 1 and 4.6 parts of Ketimine Compound 1 were placed, followed by mixing for 1 minute at 5,000 rpm with a TK homomixer (manufactured by Tokushu Kika Kogyo Co., Ltd.). Thereafter, 1,200 parts of Aqueous Phase 1 was added to the container, and the resultant mixture was mixed with the TK homomixer at 11,000 rpm for 5 minutes, to thereby produce Emulsified Slurry 1.

A container equipped with a stirrer and a thermometer was charged with Emulsified Slurry 1, followed by removing the solvent at 30° C. for 8 hours and aging at 45° C. for 4 hours, to thereby produce Dispersion Slurry 1.

—Washing and Drying—

Dispersion Slurry 1 (100 parts) was filtrated under reduced pressure and then subjected a series of treatments (1) to (4) described below:

(1): ion-exchanged water (100 parts) was added to the filtration cake, followed by mixing with a TK homomixer (at 12,000 rpm for 10 minutes) and then filtration;

(2): 10% aqueous sodium hydroxide solution (100 parts) was added to the filtration cake obtained in (1), followed by mixing with a TK homomixer (at 12,000 rpm for 30 minutes) and then filtration under reduced pressure;

(3): 10% hydrochloric acid (100 parts) was added to the filtration cake obtained in (2), followed by mixing with a TK homomixer (at 12,000 rpm for 10 minutes) and then filtration; and (4): ion-exchanged water (300 parts) was added to the filtration cake obtained in (3), followed by mixing with a TK homomixer (at 12,000 rpm for 10 minutes) and then filtration, and this operation was performed twice, to thereby produce Filtration Cake 1. Filtration Cake 1 was dried with an air-circulating drier at 45° C. for 48 hours, and then was passed through a sieve with a mesh having an aperture of 75 μm, to thereby prepare toner base particles. To obtained toner base particles (100 parts), 0.7 parts of hydrophobic silica, and 0.3 parts of hydrophobic titanium oxide were mixed by means of HENSCHEL MIXER to thereby obtain Toner 1. Toner 1 had a volume average particle diameter Dv of 5.0 μm.

Toner 1 was classified by ELBOW-JET, an air classifier of Nittetsu Mining Co., Ltd., with setting a cut point to 4.6 μm, to thereby obtain Toner 1-1 having a volume average particle diameter Dv of 4.0 μm. Moreover, Toner 1 was classified by ELBOW-JET, the air classifier, with setting a cut point to 5.6 μm, to thereby obtain Toner 1-2 having a volume average particle diameter Dv of 6.0 μm.

Next, the thermophysical properties of Toner 1, Toner 1-1, and Toner 1-2 were measured in the following manner using a differential scanning calorimeter (DSC).

<Measurement of Thermophysical Properties>

The endothermic value of the crystalline polyester resin of the toner was measured, for example, by the method described below using the DSC system (differential scanning calorimeter, Q-200, manufactured by TA INSTRUMENTS JAPAN INC.). At first, about 5.0 mg of a toner sample was weight and added to an aluminum sample container. The sample container was placed on a holder unit and set in an electric furnace. Next, in a nitrogen atmosphere (flow rate: 50 mL/min), the sample was heated from −20° C. to 150° C. at a temperature increasing rate of 1° C./min, temperature modulation cycle of 60 seconds, and temperature modulation amplitude of 0.159° C. Thereafter, the sample was cooled from 150° C. to 0° C. at a temperature decreasing rate of 10° C./min. In this process, the DSC curve of the sample was measured with a differential scanning calorimeter (Q-200, TA INSTRUMENTS JAPAN INC.). From the obtained DSC curve, the endothermic peak of the DSC curve corresponding to the crystalline polyester resin at the first temperature increase was selected, and an endothermic value was calculated. The exothermic value of the releasing agent was calculated by selecting the exothermic peak of the releasing agent at the temperature decrease.

Regarding Toner 1, Toner 1-1, and Toner 1-2, from the endothermic peak of the crystalline polyester resin, the endothermic values A, B and C were respectively 10.7 J/g, 7.4 J/g, and 13.1 J/g, and the relations were respectively calculated as follows: (B/A)×100=69.2 and (C/A)×100=122.4. From the exothermic peak of the releasing agent, the exothermic values D, E and F were respectively 11.0 J/g, 8.3 J/g, and 13.1 J/g, and the relations were respectively calculated as follows: (E/D)×100=75.8 and (F/D)×100=119.6. The results are shown in Table 1.

<Average Dispersed Particle Diameter of Crystalline Polyester Resin in Toner>

First, toner particles were embedded in an epoxy resin and it was cut out into an approximately 100 nm ultrathin section, and then stained with ruthenium tetroxide. Next, the stained sample was observed through a transmission electron microscope (TEM) at a magnification of 10,000×, and long axes of 50 toner particles were measured, followed by obtaining an average dispersed particle diameter.

The average dispersed particle diameter of the crystalline polyester resin in Toner 1 of Example 1 was 0.7 μm.

Example 2

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 25° C. or lower for 10 hours, to thereby produce Crystalline Polyester Dispersion Liquid 2.

Toner 2 was produced in the same manner as in Example 1, except that Crystalline Polyester Dispersion Liquid 2 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 2 of Example 2 was 0.2 μm as measured in the same manner as in Example 1.

Example 3

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 18° C. or lower for 24 hours, to thereby produce Crystalline Polyester Dispersion Liquid 3.

Toner 3 was produced in the same manner as in Example 1, except that Crystalline Polyester Dispersion Liquid 3 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 3 of Example 3 was 1.1 μm as measured in the same manner as in Example 1.

Example 4

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 18° C. or lower for 5 hours, to thereby produce Crystalline Polyester Dispersion Liquid 4.

Toner 4 was produced in the same manner as in Example 1, except that Crystalline Polyester Dispersion Liquid 4 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 4 of Example 4 was 0.4 μm as measured in the same manner as in Example 1.

Example 5

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 25° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 20° C. or lower for 10 hours, to thereby produce Crystalline Polyester Dispersion Liquid 5.

Toner 5 was produced in the same manner as in Example 1, except that Crystalline Polyester Dispersion Liquid 5 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 5 of Example 5 was 1.3 μm as measured in the same manner as in Example 1.

Example 6

The obtained Raw Material Solution 1 (1,324 parts) was poured into a container, and the carbon black and wax were dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 2 passes. Next, a 65% by mass ethyl acetate solution of Non-Crystalline Polyester Resin 1 (1,042.3 parts) was added thereto, and passed once with the bead mill under the above conditions, to thereby obtain Pigment-Wax Dispersion Liquid 2. The solid content of Pigment-Wax Dispersion Liquid 2 was 50% by mass (130° C., 30 minutes).

Toner 6 was produced in the same manner as in Example 1, except that Pigment-Wax Dispersion Liquid 2 was used instead of Pigment-Wax Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 6 of Example 6 was 0.8 μm as measured in the same manner as in Example 1.

Example 7

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 5° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 20° C. or lower for 10 hours, to thereby produce Crystalline Polyester Dispersion Liquid 6.

Toner 7 was produced in the same manner as in Example 1, except that Crystalline Polyester Dispersion Liquid 6 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 7 of Example 7 was 2.1 μm as measured in the same manner as in Example 1.

Example 8

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 25° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 20° C. or lower for 24 hours, to thereby produce Crystalline Polyester Dispersion Liquid 7.

Toner 8 was produced in the same manner as in Example 1, except that Crystalline Polyester Dispersion Liquid 7 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 8 of Example 8 was 0.1 μm as measured in the same manner as in Example 1.

Comparative Example 1

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 25° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 15° C. or lower for 15 hours, to thereby produce Crystalline Polyester Dispersion Liquid 8.

Toner 9 was produced in the same manner as in Example 1, except that Crystalline Polyester Dispersion Liquid 8 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 9 of Comparative Example 1 was 0.9 μm as measured in the same manner as in Example 1.

Comparative Example 2

A 2 L-metal container was charged with 100 g of Crystalline

Polyester Resin 1 and 400 g of ethyl acetate, followed by heating at 70° C. for dissolution. Thereafter, the resultant mixture was quenched in an iced-water bath at the rate of 30° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 18° C. or lower for 10 hours, to thereby produce Crystalline Polyester Dispersion Liquid 9.

Toner 10 was produced in the same manner as in Example 1, except that Crystalline Polyester Dispersion Liquid 9 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 10 of Comparative Example 2 was 0.8 μm as measured in the same manner as in Example 1.

Comparative Example 3

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 20° C. or lower for 10 hours, to thereby produce Crystalline Polyester Dispersion Liquid 10.

Toner 11 was produced in the same manner as in Example 1, except that Crystalline Polyester Dispersion Liquid 10 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 11 of Comparative Example 3 was 0.7 μm as measured in the same manner as in Example 1.

Comparative Example 4

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 20° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 27° C. or lower for 10 hours, to thereby produce Crystalline Polyester Dispersion Liquid 11.

Toner 12 was produced in the same manner as in Example 1, except that Crystalline Polyester Dispersion Liquid 11 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 12 of Comparative Example 4 was 1.1 μm as measured in the same manner as in Example 1.

Comparative Example 5

A 2 L-metal container was charged with 100 g of Crystalline Polyester Resin 1 and 400 g of ethyl acetate, followed by heating at 70° C. for dissolution. Thereafter, the resultant mixture was quenched in an iced-water bath at the rate of 25° C./min. After the resultant dispersion liquid was cooled, 100 g of Non-Crystalline Polyester Resin 1 was added thereto and made dissolved therein. Then, glass beads (3 mm in diameter) (500 mL) were added to the mixture to perform pulverization with a batch-type sand mill (manufactured by Kanpe Hapio Co., Ltd.) at the average fluid temperature of 10° C. or lower for 12 hours, to thereby produce Crystalline Polyester Dispersion Liquid 12.

Toner 13 was produced in the same manner as in Example 1, except that Crystalline Polyester Dispersion Liquid 12 was used instead of Crystalline Polyester Dispersion Liquid 1.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 13 of Comparative Example 5 was 1.0 μm as measured in the same manner as in Example 1.

Example 9

<Emulsification Aggregation Method>

—Preparation of Crystalline Polyester Dispersion Liquid—

A stainless steel beaker was charged with 180 parts of Crystalline Polyester Resin 1, and 585 parts of deionized water, and the mixture was heated to 95° C. by placing the beaker in a hot bath.

When Crystalline Polyester Resin 1 was dissolved in water and the solution became clear, a 1% ammonium water was added to the solution to adjust pH thereof to 7.0 while stirring at 10,000 rpm by means of T.K. ROBOMIX (manufactured by PRIMIX Corporation). Subsequently, emulsification dispersion was performed by adding 0.8 parts of an anionic surfactant (NEOGEN R-K, manufactured by Dai-ichi Kogyo Seiyaku Co., Ltd.), and 0.2 parts of a nonionic emulsifier (EMULGEN 950, manufactured by Kao Corporation) to 20 parts of the diluted aqueous solution dropwise, to thereby Prepare Crystalline Polyester Dispersion Liquid A (solid content: 11.9% by mass) having the volume average particle diameter of 0.8 μm.

—Preparation of Non-Crystalline Polyester Dispersion Liquid—

Non-Crystalline Polyester Dispersion Liquid B (solid content: 12.3% by mass) was prepared in the same manner as in preparation of Crystalline Polyester Dispersion Liquid, except that Crystalline Polyester Resin 1 was replaced with Non-Crystalline Polyester Resin 1.

—Preparation of Pigment Dispersion Liquid—

A container was charged with 20 parts of carbon black (Printex 35, manufactured by Degussa), 80 parts of ion-exchanged water, and 4.0 parts of an anionic surfactant (NEOGEN R-K, manufactured by Dai-ichi Kogyo Seiyaku Co., Ltd.), and the pigment was dispersed therein by means of a bead mill (ULTRA VISCOMILL, manufactured by AIMEX CO., Ltd.) under the following conditions: a liquid feed rate of 1 kg/hr, disc circumferential velocity of 6 m/s, 0.3 mm-zirconium beads packed to 80% by volume, and 15 passes, to thereby obtain Pigment Dispersion Liquid 1 (solid content: 19.8% by mass) having the volume average particle diameter of 0.07 μm.

—Preparation of Wax Dispersion Liquid—

Microcrystalline wax (Hi-Mic-1090, manufactured by Nippon Seiro Co., Ltd.) (20 parts), 80 parts of ion-exchanged water, and 4 parts of an anionic surfactant (NEOGEN R-K, manufactured by Dai-ichi Kogyo Seiyaku Co., Ltd.) were mixed, and the mixture was heated at 95° C. for 1 hour while stirring. Thereafter, the resultant was cooled, and the wax was dispersed therein by means of a bead mill (ULTRA VISCOMILL, manufactured by AIMEX CO., Ltd.) under the following conditions: a liquid feed rate of 1 kg/hr, disc circumferential velocity of 6 m/s, 0.3 mm-zirconium beads packed to 80% by volume, and 25 passes, to thereby prepare Wax Dispersion Liquid 1 (solid content: 20.8% by mass) having the volume average particle diameter of 0.15 μm.

—Preparation Method of Toner—

The following components were mixed and stirred for 2 hours at 25° C. by means of a disperser.

| | |
|---|---|
| Pigment Dispersion Liquid 1 | 26.3 parts |
| Crystalline Polyester Dispersion Liquid A | 67.2 parts |
| Non-Crystalline Polyester Dispersion Liquid B | 585.3 parts |
| Wax Dispersion Liquid 1 | 28.8 parts |

The resulting dispersion liquid was heated up to 60° C., and the pH thereof was adjusted to 7.0 with ammonium. Then, the dispersion liquid was further heated to 90° C., and the temperature was maintained for 6 hours, to thereby obtain Dispersion Slurry 2.

Dispersion Slurry 2 (100 parts) was filtrated under reduced pressure and then subjected a series of treatments (1) to (3) described below:

(1): ion-exchanged water (100 parts) was added to the filtration cake, followed by mixing with a TK homomixer (at 12,000 rpm for 10 minutes) and then filtration;

(2): 10% hydrochloric acid was added to the filtration cake obtained in (1) to adjust the pH thereof to 2.8, followed by mixing with a TK homomixer (at 12,000 rpm for 10 minutes) and then filtration; and (3): ion-exchanged water (300 parts) was added to the filtration cake obtained in (2), followed by mixing with a TK homomixer (at 12,000 rpm for 10 minutes) and then filtration, and this operation was performed twice, to thereby produce Filtration Cake 2.

Filtration Cake 2 was dried with an air-circulating drier at 45° C. for 48 hours, and then was passed through a sieve with a mesh size of 75 μm, to thereby prepare toner base particles having the volume average particle diameter of 5.9 μm. To obtained toner base particles (100 parts), 0.7 parts of hydrophobic silica, and 0.3 parts of hydrophobic titanium oxide were mixed by means of HENSCHEL MIXER to thereby obtain Toner 14.

Next, the thermophysical properties of the toner was measured, and then endothermic values of the crystalline polyester resin and exothermic values of the releasing agent were calculated in the same manner as in Example 1. The results are shown in Table 1.

The average dispersed particle diameter of the crystalline polyester resin in Toner 14 of Example 9 was 0.8 μm as measured in the same manner as in Example 1.

TABLE 1

| | Toner No. | A | B | C | D | E | F | (B/A)*100 | (C/A)*100 | (E/D)*100 | (F/D)*100 | Average dispersed particle diameter of crystalline polyester resin (μm) |
|---|---|---|---|---|---|---|---|---|---|---|---|---|
| Ex. 1 | 1 | 10.70 | 7.40 | 13.10 | 10.95 | 8.30 | 13.10 | 69.2 | 122.4 | 75.8 | 119.6 | 0.7 |
| Ex. 2 | 2 | 10.50 | 9.37 | 15.55 | 10.76 | 7.90 | 13.33 | 89.2 | 148.1 | 73.4 | 123.9 | 0.2 |
| Ex. 3 | 3 | 10.20 | 5.20 | 11.30 | 11.10 | 8.22 | 13.48 | 51.0 | 110.8 | 74.1 | 121.4 | 1.1 |
| Ex. 4 | 4 | 10.60 | 9.35 | 11.70 | 10.53 | 8.65 | 13.98 | 88.2 | 110.4 | 82.1 | 132.8 | 0.4 |
| Ex. 5 | 5 | 10.35 | 6.10 | 15.30 | 11.47 | 6.70 | 14.50 | 58.9 | 147.8 | 58.4 | 126.4 | 1.3 |
| Ex. 6 | 6 | 10.53 | 7.80 | 13.60 | 9.30 | 9.20 | 9.40 | 74.1 | 129.2 | 98.9 | 101.1 | 0.8 |
| Ex. 7 | 7 | 10.11 | 8.00 | 12.90 | 11.12 | 8.50 | 13.50 | 79.1 | 127.6 | 76.4 | 121.4 | 2.1 |
| Ex. 8 | 8 | 10.68 | 9.40 | 13.90 | 10.89 | 7.70 | 12.90 | 88.0 | 130.1 | 70.7 | 118.5 | 0.1 |
| Comp. Ex. 1 | 9 | 10.31 | 10.21 | 10.42 | 11.23 | 8.60 | 13.60 | 99.0 | 101.1 | 76.6 | 121.1 | 0.9 |
| Comp. Ex. 2 | 10 | 10.22 | 10.02 | 12.62 | 11.12 | 7.10 | 13.41 | 98.0 | 123.5 | 63.8 | 120.6 | 0.8 |
| Comp. Ex. 3 | 11 | 10.60 | 7.60 | 10.10 | 11.60 | 8.90 | 14.50 | 71.7 | 95.3 | 76.7 | 125.0 | 0.7 |
| Comp. Ex. 4 | 12 | 10.30 | 4.20 | 12.10 | 12.00 | 9.10 | 16.20 | 40.8 | 117.5 | 75.8 | 135.0 | 1.1 |
| Comp. Ex. 5 | 13 | 11.00 | 8.20 | 16.54 | 10.90 | 6.40 | 12.30 | 74.5 | 150.4 | 58.7 | 112.8 | 1.0 |
| Ex. 9 | 14 | 11.11 | 8.55 | 13.40 | 10.41 | 8.12 | 12.44 | 77.0 | 120.6 | 78.0 | 119.5 | 0.8 |

—Production of Developer—

By means of a ball mill, 5 parts of the toner and 95 parts of a carrier were mixed to produce a developer.

(Evaluation Methods and Results)

The obtained developer was evaluated in the following manners. The evaluation results are shown in Table 2.

<Fixing Ability>

The fixing portion of a copier (MF-2200, manufactured by Ricoh Company, Ltd.) employing a TEFLON roller as a fixing roller was modified to produce a modified copier. The above-produced developer and Type 6200 paper sheets (manufactured by Ricoh Company, Ltd.) were set in the modified copier for printing test.

Specifically, the cold offset temperature, i.e. minimum fixing temperature, was determined while changing the fixing temperature.

The evaluation conditions for the minimum fixing temperature were set as follows: linear velocity of paper feeding: 120 mm/sec to 150 mm/sec, surface pressure: 1.2 kgf/cm$^2$ and nip width: 3 mm.

The evaluation conditions for the maximum fixing temperature were set as follows: linear velocity of paper feeding: 50 mm/sec, surface pressure: 2.0 kgf/cm$^2$ and nip width: 4.5 mm.

The lower minimum fixing temperature was more preferable as the power consumption reduced, and the minimum fixing temperature of 130° C. or lower was an acceptable level in actual practice, without any problem.

The evaluation criteria were as follow:

A: The minimum fixing temperature was lower than 125° C.

B: The minimum fixing temperature was 125° C. to 130° C.

C: The minimum fixing temperature was around 130° C., but cold offset slightly occurred.

D: The minimum fixing temperature was higher than 130° C.

<Heat Resistant Storage Stability>

A 50 mL-glass container was filled with the toner, and left in a thermostat of 50° C. for 24 hours, followed by cooling to 24° C. The toner was then subjected to the measurement of a penetration degree in accordance with a penetration degree test as prescribed in JIS K2235-1991, and evaluated in terms of heat resistant storage stability thereof. The larger the penetration degree was, the more excellent the heat resistant storage stability was. The toner giving the penetration degree of less than 5 mm had the possibility of causing problems upon use.

The evaluation criteria were as follow:

A: The penetration degree was 25 mm or more.

B: The penetration degree was 15 mm or more, but less than 25 mm.

C: The penetration degree was 5 mm or more, but less than 15 mm.

D: The penetration degree was less than 5 mm.

<Granulation Properties>

The particle diameter of the toner was measured using a particle size measuring instrument "Coulter Counter TAII", manufactured by Beckmann Coulter Inc., with an aperture diameter of 100 μm. Granulation properties was evaluated based on the particle size distribution obtained from a volume average particle diameter and a number average particle diameter.

The evaluation criteria were as follow:

A: The particle size distribution was 1.10 or more but less than 1.15.

B: The particle size distribution was 1.15 or more but less than 1.20.

C: The particle size distribution was 1.20 or more.

<Filming>

Printing of 10,000 images was performed using an image forming apparatus MF2800 (manufactured by Ricoh Company, Ltd.), and then a photoconductor was visually observed and evaluated for adhesion of toner components, particularly the releasing agent, onto the photoconductor.

The evaluation was based on the following criteria.

A: No adhesion of the toner component onto the photoconductor was observed.

B: Adhesion of the toner component onto the photoconductor was observed to such an extent that it did not involve problems in practical use.

C: Adhesion of the toner component onto the photoconductor was observed to such an extent that it involved problems in practical use.

D: Adhesion of the toner component onto the photoconductor was observed to such an extent that it involved great problems in practical use.

<Image Evaluation>

A supply bottle was filled with the toner, and stored at 30° C. and 60% RH for 4 weeks. The developer and the toner supply bottle were used for continuous printing of 100 solid images, by means of IMAGIO NEO 450 manufactured by Ricoh Company Limited, which could output 45 sheets (A4 size) per minute. The resultant images were evaluated based on the following criteria.

A: Uniform and excellent solid image.

B: White line(s) in the width of less than 0.3 mm was slightly observed, but it was not clearly shown in the solid image.

C: White line(s) in the width of 0.3 mm or more was observed, and white line was observed in the solid image on less than 20 sheets out of 100 sheets.

D: White line(s) in the width of 0.3 mm or more was observed, and white line was observed in the solid image on 20 sheets or more out of 100 sheets.

TABLE 2

| | Toner No. | Fixing ability | Granulation properties | Heat resistant storage stability | Filming | Image evaluation |
|---|---|---|---|---|---|---|
| Ex. 1 | 1 | A | A | A | A | A |
| Ex. 2 | 2 | A | B | A | B | B |
| Ex. 3 | 3 | B | A | B | A | A |
| Ex. 4 | 4 | B | A | B | A | A |
| Ex. 5 | 5 | B | A | B | A | A |
| Ex. 6 | 6 | A | A | A | A | B |
| Ex. 7 | 7 | B | B | A | B | B |
| Ex. 8 | 8 | A | A | B | A | A |
| Comp. Ex. 1 | 9 | B | B | C | B | C |
| Comp. Ex. 2 | 10 | A | B | D | B | B |
| Comp. Ex. 3 | 11 | B | B | C | A | B |
| Comp. Ex. 4 | 12 | D | B | B | B | C |
| Comp. Ex. 5 | 13 | C | D | B | B | B |
| Ex. 9 | 14 | A | A | A | A | A |

From the results of Tables 1 and 2, all of the toners of Examples 1 to 8 had the desirable results in the evaluation items of the low temperature fixing ability, granulation properties, heat resistant storage stability and filming, and images having high quality could be obtained. With more specific consideration, due to the influence of the large dispersed particle diameter of the crystalline polyester resin, Example 2 was slightly inferior in the granulation properties to Example 1. Example 2 was also slightly inferior in the filming to Example 1. In Example 3, the amounts of the crystalline polyester resin decreased in both the large toner particles and the small toner particles in comparison to Example 1, and Example 3 was slightly inferior in the heat resistant storage stability and low temperature fixing ability to Example 1. In Example 4, in comparison to Example 1, the amount of the crystalline polyester resin in the small toner particles increased. On the other hand, in Example 5, the amount of the crystalline polyester resin in the large toner particles increased. The toners of Examples 4 and 5 were close in quality. Thus, it could be understood that there was trade-off between the low temperature fixing ability and the heat resistant storage stability. In Example 6, a large amount of the releasing agent was contained in the small toner particles, and image quality became slightly poor. In Example 7, the crystalline polyester resin had a large dispersed particle diameter, and the heat resistant storage stability was suitable, but the particle size distribution of the toner became slightly poor. In Example 8, the crystalline polyester resin had a small dispersed particle diameter, and Example 8 was slightly inferior in the heat resistant storage stability to Example 1, but the toner of Example 8 had a quality close to that of the toner of Example 1. The toner of Example 9 produced by an emulsification aggregation method had excellent toner quality equivalent to the toner of Example 1.

In comparison with the toner of Example 1, a large amount of the crystalline polyester resin was contained in the small toner particles of the toner of Comparative Example 1, causing degradation of the heat resistant storage stability and the image evaluation. In the toner of Comparative Example 2, a large amount of the crystalline polyester resin was contained in the small toner particles, and the toner of Comparative Example 2 contained a larger amount of the crystalline polyester resin in the large toner particles, compared to that of the Comparative Example 1. Thus, the heat resistant storage stability was further degraded. In Comparative Example 3, a large amount of the crystalline polyester resin was contained in the large toner particles, and the amount of the crystalline polyester resin in the small toner particles in Comparative Example 3 was smaller than that in Comparative Example 1. Thus, the heat resistant storage stability was degraded. In Comparative Example 4, since the crystalline polyester resin was hardly contained in the small toner particles, the low temperature fixing ability was significantly degraded. In Comparative Example 5, a large amount of the crystalline polyester resin was contained in the large toner particles, and the low temperature fixing ability and the granulation properties were degraded.

Thus, the present invention provides a toner having stable and suitable low temperature fixing ability and heat resistant storage stability, a developer containing the toner, a developer container, a process cartridge, an image forming apparatus and an image forming method, which use the toner, developer, developer container, and process cartridge.

This application claims priority to Japanese patent application No. 2010-206472, filed on Sep. 15, 2010, and incorporated herein by reference.

What is claimed is:

1. A toner comprising:

toner particles, each toner particle comprising:

a binder resin;

a releasing agent; and a colorant, wherein the binder resin comprises at least a crystalline polyester resin and a non-crystalline polyester resin, wherein in the case where a volume average particle diameter of the toner is defined as Dv, the toner contains a group of the toner particles having the volume average particle diameter of 4/5 Dv, and a group of the toner particles having the volume average particle diameter of 6/5 Dv, and wherein an endothermic value A of the crystalline polyester resin at a first temperature increase in a differential scanning calorimetry of the toner, an endothermic value B of the crystalline polyester resin at a first temperature increase in a differential scanning calorimetry of the group of the toner particles having the volume average particle diameter of 4/5 Dv after classification, and an endothermic value C of the crystalline polyester resin at a first temperature increase in a differential scanning calorimetry of the group of the toner particles having the volume average particle diameter of 6/5 Dv after classification satisfy the relation represented by the following formulas:

$$50<(B/A)\times 100<90, \text{ and}$$

$$110<(C/A)\times 100<150.$$

2. The toner according to claim 1, wherein the endothermic value A, the endothermic value B, and the endothermic value C satisfy the relation represented by the following formulas:

$$60<(B/A)\times 100<80, \text{ and}$$

$$110<(C/A)\times 100<130.$$

3. The toner according to claim 1, wherein an exothermic value D of the releasing agent upon temperature decrease after the first temperature increase in the differential scanning calorimetry of the toner, an exothermic value E of the releasing agent upon temperature decrease after the first temperature increase in the differential scanning calorimetry of the group of the toner particles having the volume average particle diameter of 4/5 Dv after classification, and an exothermic value F of the releasing agent upon temperature decrease after the first temperature increase in the differential scanning calorimetry of the group of the toner particles having the volume average particle diameter of 6/5 Dv after classification satisfy the relation represented by the following formulas:

$$50<(E/D)\times 100<90, \text{ and}$$

$$110<(F/D)\times 100<150.$$

4. The toner according to claim 1, wherein the toner is obtained by emulsifying or dispersing in an aqueous medium a liquid in which a toner material containing the binder resin and the releasing agent is dissolved or dispersed in an organic solvent.

5. The toner according to claim 1, wherein the toner is obtained by a method comprising:

dissolving or dispersing at least the colorant, the releasing agent, the crystalline polyester resin, a compound containing an active hydrogen group, a binder resin precursor having a portion reactive with the compound containing an active hydrogen group, and a binder resin component other than the foregoing in an organic solvent to obtain an oil phase;

dispersing the oil phase in an aqueous medium containing a fine particle dispersant to obtain an emulsified dispersion liquid, allowing the binder resin precursor and the compound containing an active hydrogen group to undergo a crosslinking reaction, an elongation reaction, or both thereof in the emulsified dispersion liquid, and removing the organic solvent.

6. The toner according to claim 1, wherein the toner is obtained by a method comprising:

dispersing the crystalline polyester resin and the non-crystalline polyester resin respectively in a separate aqueous media to emulsify the crystalline polyester resin and the non-crystalline polyester resin as crystalline polyester resin particles, and non-crystalline polyester resin particles, respectively;

mixing the crystalline polyester resin particles, the non-crystalline polyester resin particles, a wax dispersion liquid, and a colorant dispersion liquid to prepare a dispersion liquid containing aggregated particles;

heating the dispersion liquid containing aggregated particles to a temperature equal to or higher than a glass transition temperature of the resin particles to thereby fuse the aggregated particles into toner particles; and washing the toner particles.

7. The toner according to claim 1, wherein the crystalline polyester resin has an average dispersed particle diameter of 0.1 μm to 2.0 μm as a long axis in the toner particles.

8. A developer comprising a toner, the toner comprising:

toner particles, each toner particle comprising:

a binder resin;

a releasing agent; and a colorant, wherein the binder resin comprises at least a crystalline polyester resin and a non-crystalline polyester resin, wherein in the case where a volume average particle diameter of the toner is defined as Dv, the toner contains a group of the toner particles having the volume average particle diameter of 4/5 Dv, and a group of the toner particles having the volume average particle diameter of 6/5 Dv, and wherein an endothermic value A of the crystalline polyester resin at a first temperature increase in a differential scanning calorimetry of the toner, an endothermic value B of the crystalline polyester resin at a first temperature increase in a differential scanning calorimetry of the group of the toner particles having the volume average particle diameter of 4/5 Dv after classification, and an endothermic value C of the crystalline polyester resin at a first temperature increase in a differential scanning calorimetry of the group of the toner particles having the volume average particle diameter of 6/5 Dv after classification satisfy the relation represented by the following formulas:

$$50<(B/A)\times 100<90, \text{ and}$$

$$110<(C/A)\times 100<150.$$

9. An image forming method comprising:

forming a latent electrostatic image on a latent electrostatic image bearing member;

developing the latent electrostatic image with a toner to form a visible image;

transferring the visible image to a recording medium; and fixing the visible image transferred to the recording medium thereon, wherein the toner comprises:

toner particles, each toner particle comprising:

a binder resin;

a releasing agent; and a colorant, wherein the binder resin comprises at least a crystalline polyester resin and a non-crystalline polyester resin, wherein in the case where a volume average particle diameter of the toner is defined as Dv, the toner contains a group of the toner particles having the volume average particle diameter of 4/5 Dv, and a group of the toner particles having the volume average particle diameter of 6/5 Dv, and wherein an endothermic value A of the crystalline polyester resin at a first temperature increase in a differential scanning calorimetry of the toner, an endothermic value B of the crystalline polyester resin at a first temperature increase in a differential scanning calorimetry of the group of the toner particles having the volume average particle diameter of 4/5 Dv after classification, and an endothermic value C of the crystalline polyester resin at a first temperature increase in a differential scanning calorimetry of the group of the toner particles having the volume average particle diameter of 6/5 Dv after classification satisfy the relation represented by the following formulas:

$$50<(B/A)\times 100<90, \text{ and}$$

$$110<(C/A)\times 100<150.$$

* * * * *